US011025005B1

(12) United States Patent
Shimizu

(10) Patent No.: US 11,025,005 B1
(45) Date of Patent: Jun. 1, 2021

(54) LEVER-TYPE CONNECTOR

(71) Applicants: AUTONETWORKS TECHNOLOGIES, LTD., Yokkaichi (JP); SUMITOMO WIRING SYSTEMS, LIMITED, Yokkaichi (JP); SUMITOMO ELECTRIC INDUSTRIES, LTD., Osaka (JP)

(72) Inventor: Toru Shimizu, Yokkaichi (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/636,569

(22) PCT Filed: Sep. 19, 2018

(86) PCT No.: PCT/JP2018/034558
§ 371 (c)(1),
(2) Date: Feb. 4, 2020

(87) PCT Pub. No.: WO2019/065387
PCT Pub. Date: Apr. 4, 2019

(30) Foreign Application Priority Data

Sep. 28, 2017 (JP) ..... JP2017-188446

(51) Int. Cl.
*H01R 13/62* (2006.01)
*H01R 13/629* (2006.01)
(Continued)

(52) U.S. Cl.
CPC ..... *H01R 13/62938* (2013.01); *H01R 13/193* (2013.01); *H01R 13/521* (2013.01); *H01R 13/5202* (2013.01)

(58) Field of Classification Search
CPC ..... H01R 13/62938; H01R 13/193; H01R 13/5202; H01R 13/521
(Continued)

(56) References Cited

U.S. PATENT DOCUMENTS 5,810,612 A * 9/1998 Flask ..... H01R 13/62938 439/157
6,439,902 B1 * 8/2002 Cole ..... H01R 13/62938 439/157
(Continued)

FOREIGN PATENT DOCUMENTS

JP 2008-218331 A 9/2008
JP 4496475 B2 7/2010
JP 2017-126406 A 7/2017

OTHER PUBLICATIONS

Dec. 4, 2018 International Search Report issued in International Patent Application No. PCT/JP2018/034558.

*Primary Examiner* — Abdullah A Riyami
*Assistant Examiner* — Vladimir Imas
(74) *Attorney, Agent, or Firm* — Oliff PLC

(57) ABSTRACT

A lever-type connector including a female terminal, a female housing, a contact pressure applying member attached to the female housing from a front side in a fitting direction and can be moved between a low contact pressure position at which the female terminal is brought into contact with a male terminal with low contact pressure and a high contact pressure position that is located on a rear side in the fitting direction with respect to the low contact pressure position and at which the female terminal is brought into contact with the male terminal with high contact pressure due to application of contact pressure to the female terminal. A lever is movably attached to the female housing to move the contact
(Continued)

pressure applying member from the low to the high position after the completion of fitting.

4 Claims, 26 Drawing Sheets

(51) Int. Cl.
*H01R 13/52* (2006.01)
*H01R 13/193* (2006.01)

(58) Field of Classification Search
USPC ..... 439/157
See application file for complete search history.

(56) References Cited

U.S. PATENT DOCUMENTS 6,565,372 B2 * 5/2003 Bakker ..... H01R 13/4538 439/157
6,761,568 B2 * 7/2004 Bakker ..... H01R 13/631 439/140
6,824,406 B1 * 11/2004 Sharpies ..... H01R 13/62977 439/157
6,846,191 B2 * 1/2005 Hobbs ..... H01R 13/4538 439/140
6,896,531 B2 * 5/2005 Bakker ..... H01R 13/4538 439/140
6,971,894 B2 12/2005 Dillon et al.
7,241,156 B1 * 7/2007 Margrave ..... H01R 13/62938 439/157
7,267,583 B1 * 9/2007 Smith ..... H01R 13/193 439/660
8,882,521 B2 * 11/2014 Conway ..... H01R 13/62977 439/157

* cited by examiner

LEVER-TYPE CONNECTOR

TECHNICAL FIELD

The technology disclosed in this specification relates to a lever-type connector.

BACKGROUND ART

Conventionally, it has been known that contact wear occurs when a male tab comes into sliding contact with an elastic contact piece of a female terminal during the fitting of a connector. The connector disclosed in Japanese Patent No. 4496475 (Patent Document 1 below) is known as a connector provided with countermeasures against this problem. This connector includes a male connector housing having a hood portion that is open forward, and a female connector housing that can be fitted into the hood portion, the female connector housing being provided with a bendable locking arm. A female terminal fitting having an elastic contact piece is accommodated in the female connector housing, and a contact pressure receiving portion that protrudes downward and is configured to push down the elastic contact piece is provided on the lower surface of the locking arm. A locking protrusion is provided on the upper surface of the locking arm. When the female connector housing is fitted into the hood portion, the locking arm is pushed downward while the locking protrusion comes into sliding contact with the opening of the hood portion, and thus the contact pressure receiving portion pushes down the elastic contact piece. If a male tab enters the polygonal tube portion of the female terminal fitting in this state, the male tab does not come into contact with the elastic contact piece, thus making it possible to prevent contact wear.

However, with this connector, the female connector housing needs to be provided with an opening through which the contact pressure receiving portion can be inserted. If a water sealing structure is provided on the opening, the overall structure of the connector will become complicated, thus making it difficult to apply this connector to a waterproof connector.

To address this, the connector disclosed in JP 2008-218331A (Patent Document 2 below) is known as a connector in which contact wear is suppressed and waterproofing can be achieved. This connector has a sealing member that comes into intimate contact with a hood portion of a male housing and a housing main body portion of a female housing, and a gap between the female housing and the male housing can be sealed with this sealing member. Two protruding pieces that protrude forward are provided on the back wall portion of the male housing, and two bulging portions that protrude laterally are provided on the two sides of a contact piece of a female terminal. The two bulging portions move up on the two protruding pieces immediately before the female housing and the male housing are fitted to each other, and thus a tab comes into contact with a contact portion of the contact piece with high contact pressure, and is connected thereto such that electrical conduction can be established. This configuration makes it possible to suppress contact wear caused by sliding contact of the tab with the contact portion of the contact piece during the fitting.

However, although with this connector, contact wear that occurs during the fitting can be suppressed, high contact pressure is applied immediately before the female housing and the male housing are fitted to each other, and thus contact wear still occurs. Therefore, it is difficult to say that it can suppress contact wear.

SUMMARY

Problems of Patent Documents 1 and 2 are as described above. A connector that can be applied to a waterproof connector and in which contact wear can be suppressed has not been realized up to now.

A lever-type connector disclosed in this specification includes: a female terminal that can come into contact with a male terminal held in a male housing; a female housing that internally accommodates the female terminal and can be fitted to the male housing; a contact pressure applying member that is attached to the female housing from a front side in a fitting direction and can be moved between a low contact pressure position at which the female terminal is brought into contact with the male terminal with low contact pressure and a high contact pressure position that is located on a rear side in the fitting direction with respect to the low contact pressure position and at which the female terminal is brought into contact with the male terminal with high contact pressure due to application of contact pressure to the female terminal; a lever that is movably attached to the female housing, moves the male housing in the fitting direction, and moves the contact pressure applying member from the low contact pressure position to the high contact pressure position after the completion of fitting; a first seal that seals a through hole in the female housing through which the contact pressure applying member passes from water; and a second seal that seals a fitting portion where the female housing and the male housing are fitted to each other from water.

With this configuration, before the female housing and the male housing are completely fitted to each other, the contact pressure applying member is located at the low contact pressure position, and the female terminal is in contact with the male terminal with low contact pressure, thus making it possible to prevent contact wear. After the female housing and the male housing are completely fitted to each other, the contact pressure applying member is moved to the high contact pressure position by the lever, and thus the female terminal is in contact with the male terminal with high contact pressure. During this period, the fitting operation for fitting the female housing and the male housing to each other remains stopped, thus making it possible to prevent contact wear even when the low contact pressure state changes to the high contact pressure state.

The through hole of the female housing can be sealed from water with the first seal, and the fitting portion where the female housing and the male housing are fitted to each other can be sealed from water with the second seal, thus making it possible to apply the lever-type connector to a waterproof connector.

The lever-type connector disclosed in this specification may also have a configuration described below.

A configuration may also be employed in which the lever includes a cam groove, and the cam groove includes: a fitting track configured to be engaged with a cam pin provided on the male housing and to thereby allow a fitting operation to be performed; and an idling track configured to allow the fitting operation to remain stopped when the lever is continuously moved after the completion of fitting.

With this configuration, the cam groove includes the fitting track and the idling track, and therefore, the fitting operation does not proceed even when the lever is continuously moved after the female housing and the male housing are completely fitted to each other using the fitting track, thus making it possible to maintain the female housing and the male housing in the state in which they are completely fitted to each other.

A configuration may also be employed in which the lever includes a driving shaft, the contact pressure applying member includes: a driving portion provided with a driving track configured to be engaged with the driving shaft and to thereby allow movement from the low contact pressure position to the high contact pressure position; and a contact pressure applying portion configured to press the female terminal and apply contact pressure, and the driving portion is provided passing through the through hole.

With this configuration, the driving portion is arranged at a position separate from the position of the contact pressure applying portion that presses the female terminal, thus making it possible to provide the first seal without being limited by the arrangement of the female terminal.

A configuration is employed in which the female housing includes an attachment target portion to which the driving portion is attached, and the driving portion is accommodated in a gap between the attachment target portion and the lever after the female housing and the male housing are completely fitted to each other.

With this configuration, the driving portion is accommodated in the gap between the attachment target portion and the lever, thus making it possible to prevent the driving portion from becoming dislodged from the attachment target portion while the driving portion is moving from the low contact pressure position to the high contact pressure position.

With the technology disclosed in this specification, a lever-type connector that can be applied to a waterproof connector and with which a low contact pressure state is maintained during fitting and a high contact pressure state is brought about after the fitting can be provided.

DESCRIPTION OF EMBODIMENTS

Embodiment 1

Figure 1:
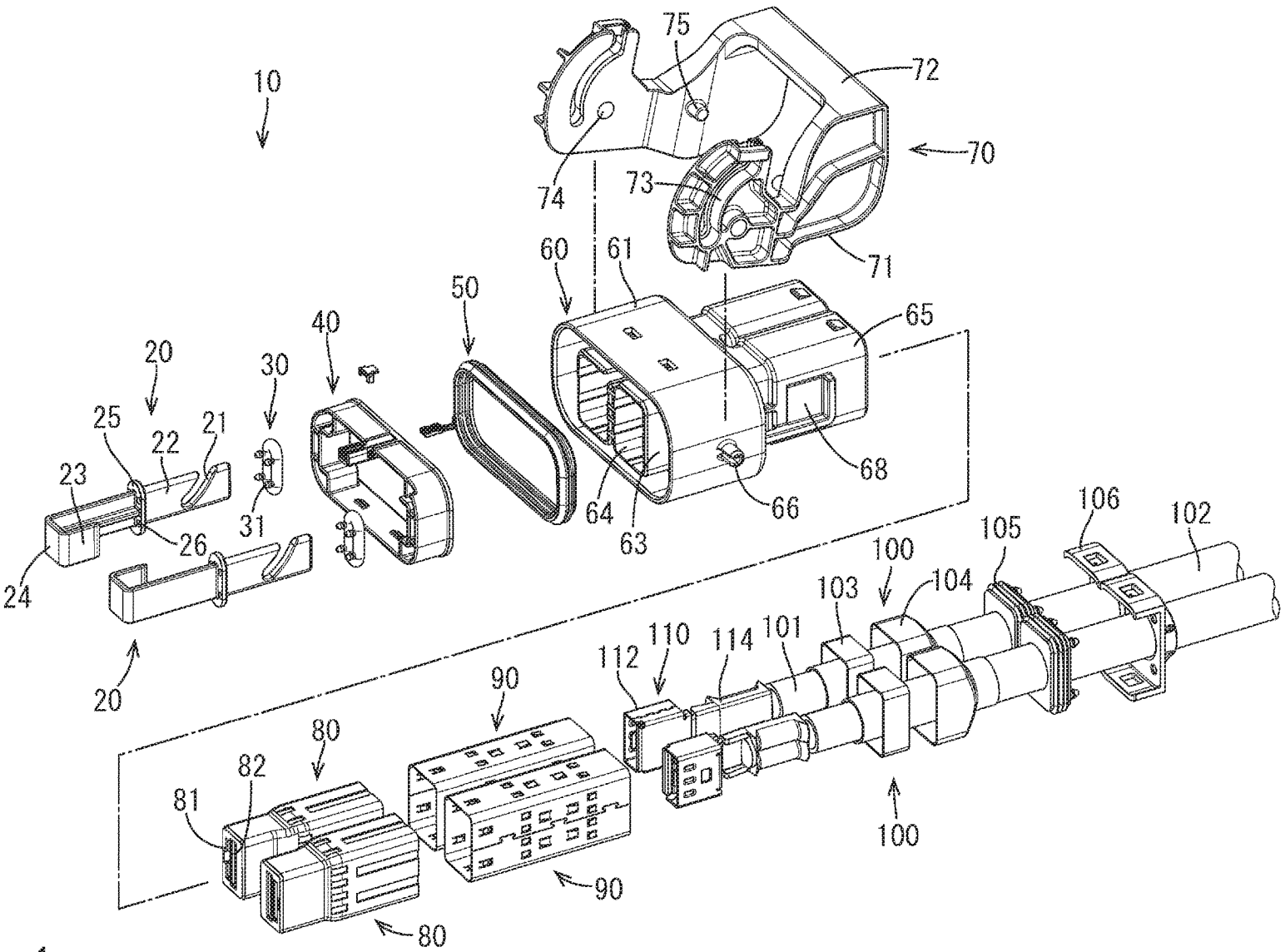
FIG. 1 is an exploded perspective view illustrating constituent components of a lever-type connector of Embodiment 1.

Embodiment 1 will be described with reference to the diagrams shown in FIGS. 1 to 21. As shown in FIG. 1, a lever-type connector 10 according to embodiment 1 includes two contact pressure applying members 20, two first seals 30, a front cover 40, a second seal 50, a female housing 60, a lever 70, two terminal covers 80, two shield shells 90, and two electric wires 100 with a terminal, for example.

Figure 5:
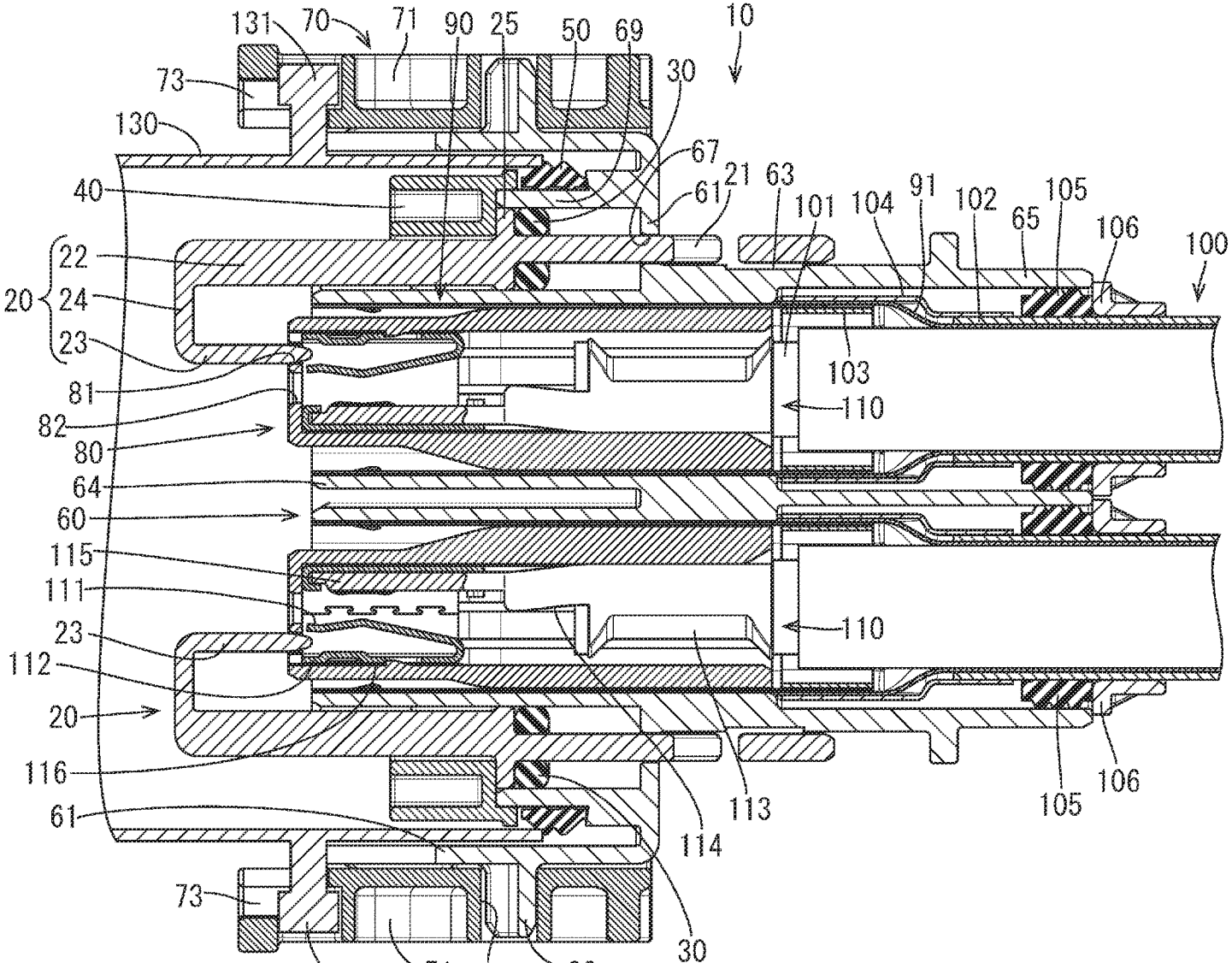
FIG. 5 is a cross-sectional view taken along line A-A in FIG. 4.
Figure 6:
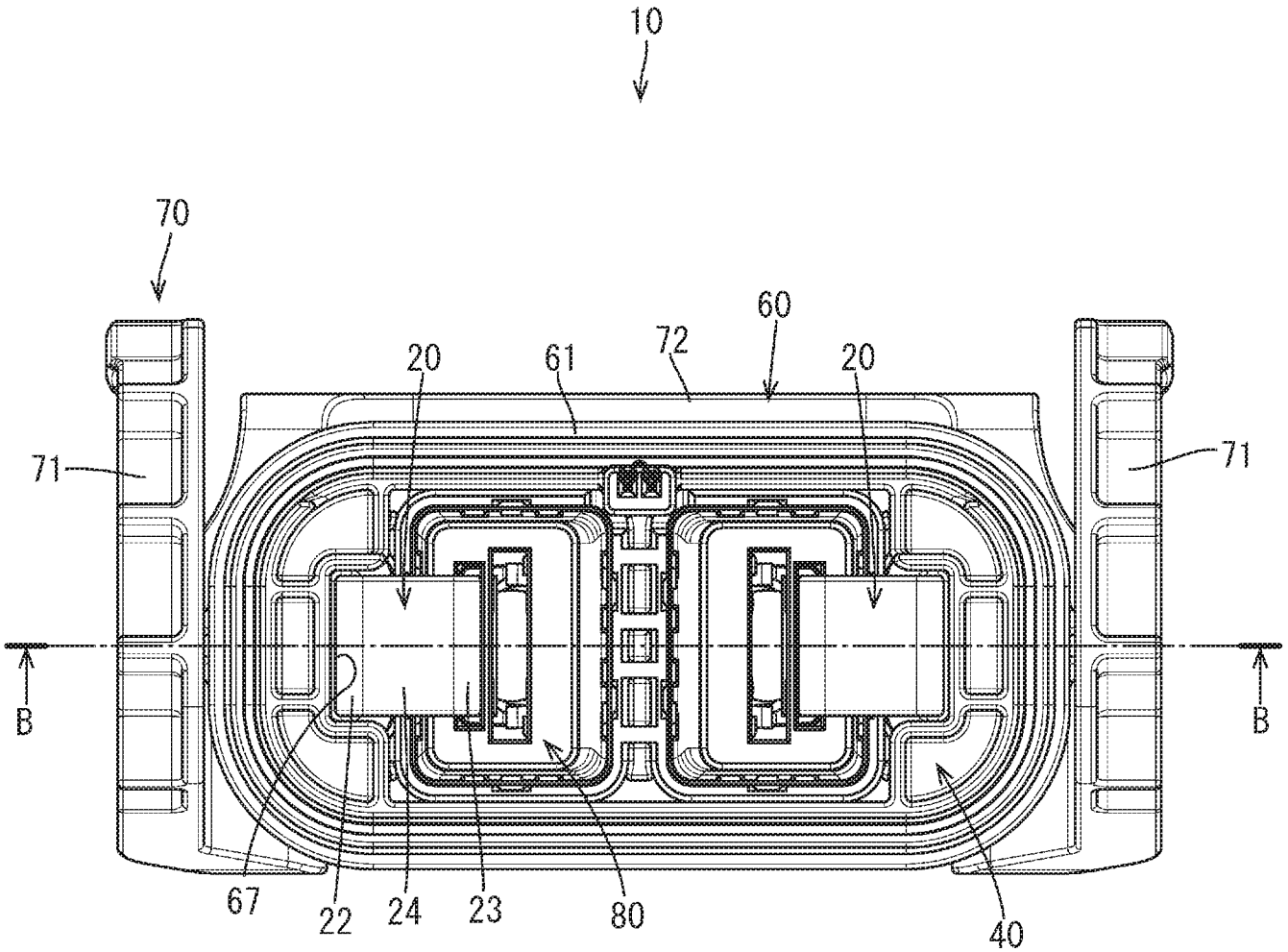
FIG. 6 is a front view of the lever-type connector, illustrating a state in which the lever is located at the rotation end position.

As shown in FIG. 5, each of the electric wires 100 with a terminal includes doubly coated shielded electric wire 101, a female terminal 110 connected to an internal conductor included in the shielded electric wire 101, a grommet 103 and a crimp ring 104 between which an external conductor 91 included in the shielded electric wire 101 and the rear end portion of the shield shell 90 are sandwiched, a third seal 105 that is in intimate contact with the outer circumferential surface of a sheath 102 included in the shielded electric wire 101, and a back retainer 106 that prevents the dislodgement of the third seal.

As shown in FIG. 5, the female terminal 110 includes a polygonal tube portion 112 that has an elastic contact piece 111, and an electric wire connecting portion 114 that has a barrel portion 113 crimped to the internal conductor of the shielded electric wire 101. A metal plate forming the polygonal tube portion 112 is thinner and harder than a metal plate forming the electric wire connecting portion 114. The electric wire connecting portion 114 has a terminal connecting portion 115 that is inserted into the polygonal tube portion 112 from the rear side, and this terminal connecting portion 115 can be connected to a male terminal 120 held by a male housing 130. A busbar made of a conductive metal plate material is used as the male terminal 120 of this embodiment.

The elastic contact piece 111 has an overall bulging shape, and extends forward in the form of a cantilever. Specifically, the elastic contact piece 111 is provided so as to be folded back forward from the rear end of a circumferential wall portion 116 included in the polygonal tube portion 112, and a gap is provided between the front end of the elastic contact piece 111 and the circumferential wall portion 116. A contact pressure applying portion 23, which will be described later, can enter this gap from the front side.

The terminal connecting portion 115 is arranged opposite to the apex of the elastic contact piece 111, and has a shape including two rising portions that are lined up in the front-rear direction. These rising portions serve as contact portions that come into contact with the male terminal 120. The contact portions lined up in the front-rear direction are arranged at two positions that are lined up in the front-rear direction and are symmetrical with respect to the apex of the elastic contact piece 111.

The female terminal 110 is accommodated and held in the terminal cover 80, and the terminal cover 80 is accommodated and held in the shield shell 90. The shield shell 90 protrudes to the rear side with respect to the rear end of the terminal cover 80, and this protruding portion is connected to the external conductor 91 of the shielded electric wire 101. Specifically, the shield shell 90 and the external conductor 91 of the shielded electric wire 101 are crimped together between the grommet 103 arranged on the inner circumference of the shield shell 90 and the crimp ring 104 arranged on the outer circumference of the shield shell 90. In addition, the rear end of the crimp ring 104 is adhered to the sheath 102 of the shielded electric wire 101.

The female housing 60 is made of synthetic resin, and includes a hood portion 61 that is open forward, and a housing main body 63 that is arranged passing through a back wall 62 of the hood portion 61. The housing main body 63 includes terminal cover housing portions 64 in which the terminal covers 80 are accommodated, and a third seal housing portion 65 in which the third seals 105 are accommodated. The third seals 105 are in intimate contact with both the outer circumferential surface of the sheath 102 of the shielded electric wire 101 and the inner circumferential surface of the third seal housing portion 65, and the back retainer 106 restricts the rearward movement of the third seals 105. This restricts the infiltration of water from the rear side into the third seal housing portion 65.

A second seal attachment wall 69 on which the second seal 50 is fitted is provided around the inside of the hood portion 61. The front cover 40 is attached to the front side of the second seal attachment wall 69. This front cover 40 restricts the dislodgement of the second seal 50 from the second seal attachment wall 69 to the front side. When the male housing 130 enters the gap between the hood portion 61 and the second seal attachment wall 69, the second seal 50 comes into intimate contact with both the male housing 130 and the second seal attachment wall 69, and thus the infiltration of water from between the female housing 60 and the male housing 130 into the second seal attachment wall 69 is restricted.

Figure 16:
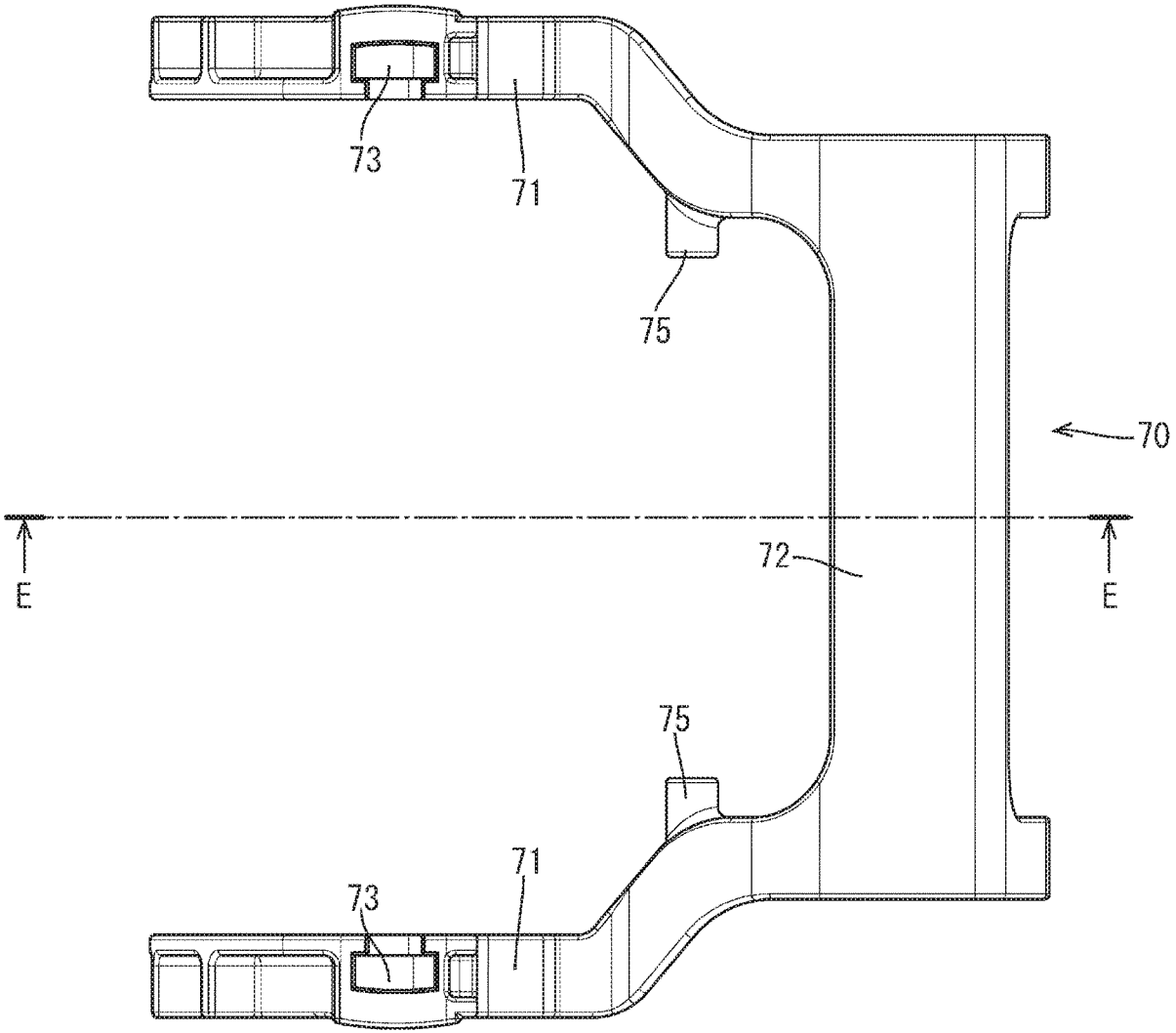
FIG. 16 is a plan view of the lever.
Figure 17:
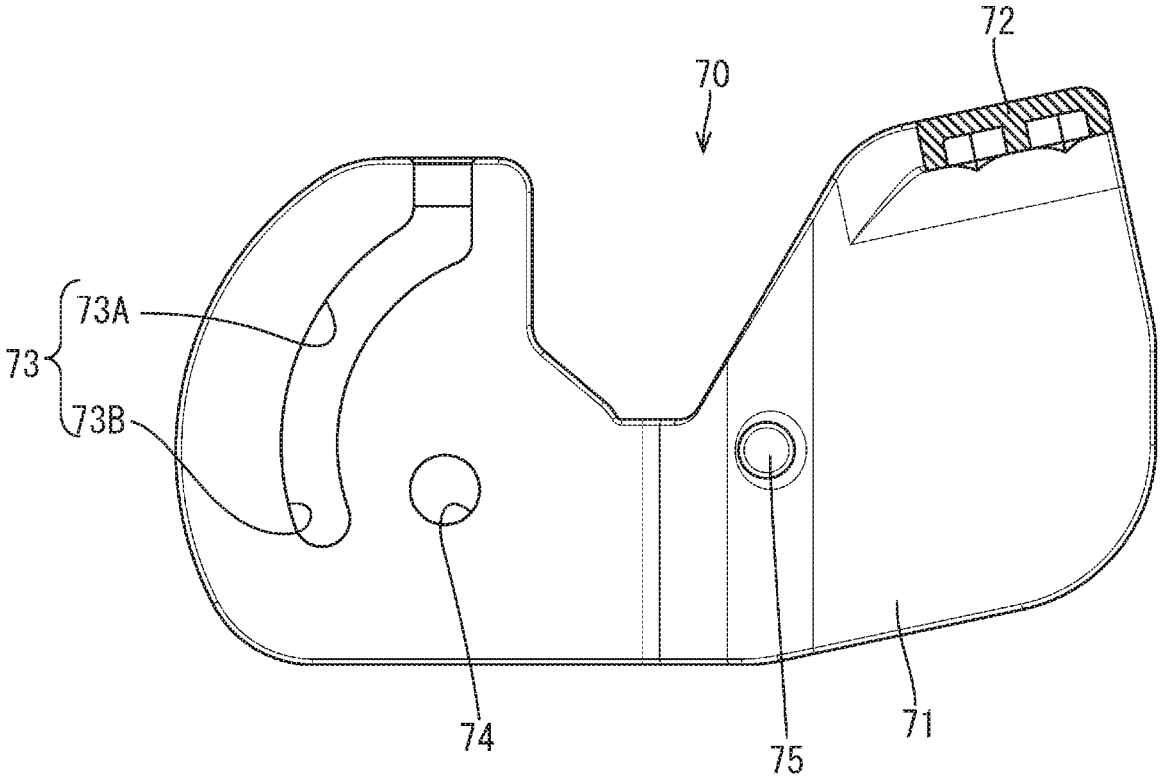
FIG. 17 is a cross-sectional view taken along line E-E in FIG. 16.

The lever 70 substantially has a gate shape as a whole. As shown in FIG. 16, two cam plate portions 71 are coupled via an operation portion 72. As shown in FIG. 17, each of the cam plate portions 71 is provided with a cam groove 73 into which a cam pin 131 provided on the male housing 130 can enter, and this cam groove 73 is formed to be substantially arc-shaped around a rotation hole 74 to which a rotation shaft 66 provided on the female housing 60 is fitted. More specifically, the cam groove 73 includes a fitting track 73A that is formed such that it approaches the rotation hole 74 as it extends from the entrance portion toward the near side of the back end portion, and an idling track 73B that is formed to be continuous with the fitting track 73A and is spaced equidistantly around the rotation hole 74.

Figure 18:
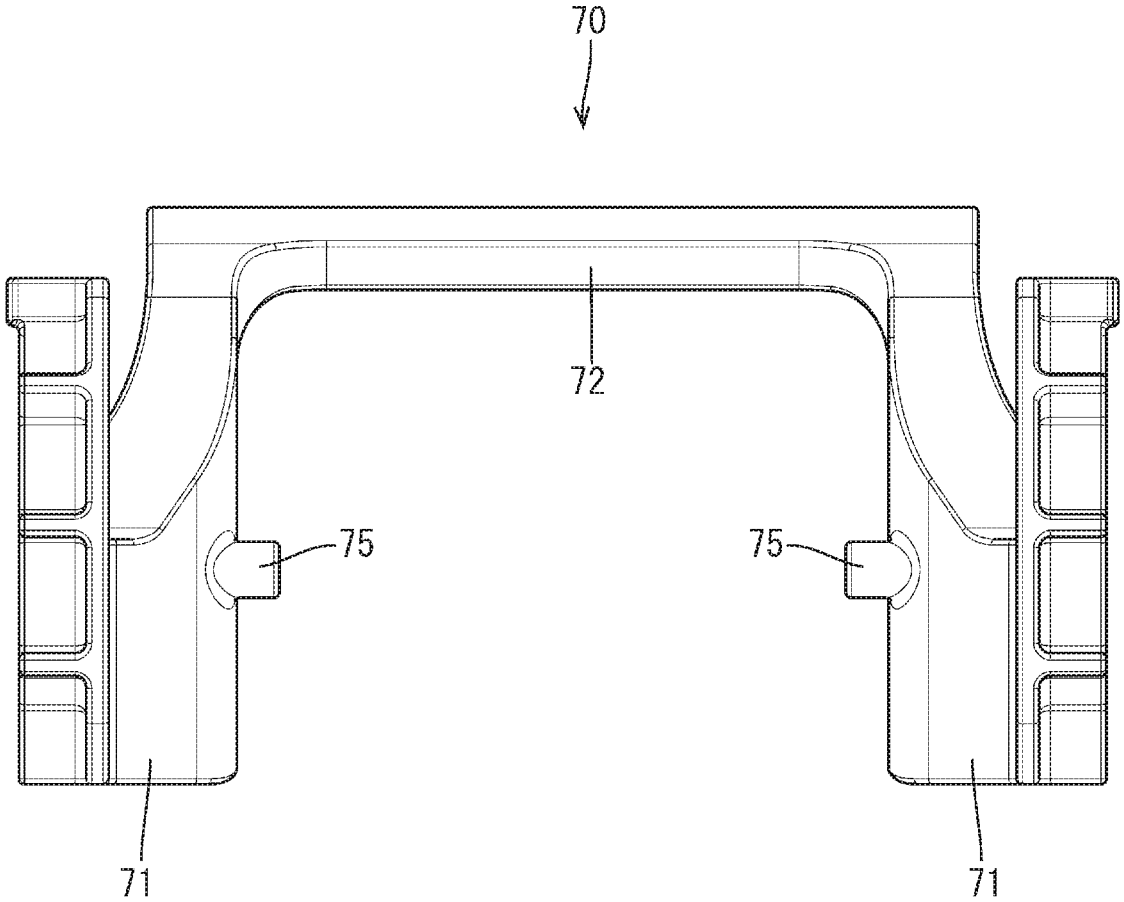
FIG. 18 is a side view of the lever.

As shown in FIGS. 17 and 18, the cam plate portion 71 is provided with a driving shaft 75 that protrudes at a position opposite to the idling track 73B of the cam groove 73 with respect to the rotation hole 74. The driving shaft 75 is located on the rotation hole 74 side with respect to the operation portion 72. The driving shaft 75 on one cam plate portion 71 and the driving shaft 75 on the other cam plate portion 71 protrude facing each other.

The lever 70 is rotatably attached to the female housing 60 by fitting the two rotation shafts 66 to the two rotation holes 74 from the inside. The lever 70 can be rotated from a rotation start position shown by a long-double-short-dashed line in FIGS. 12 and 13 via a fitting completion position shown in FIGS. 8 and 9 to a rotation end position shown by a long-double-short-dashed line in FIGS. 14 and 15. At the rotation start position, the entrance portion of the cam groove 73 faces forward, and the cam groove 73 can receive the cam pin 131.

By rotating the lever 70 to the fitting completion position after the female housing 60 and the male housing 130 are lightly fitted to each other and the cam pins 131 enter the entrance portions of the cam grooves 73, the cam pins 131 move along the fitting tracks 73A of the cam grooves 73, and thus the female housing 60 and the male housing 130 are completely fitted to each other. By further rotating the lever 70 to the rotation end position, the cam pins 131 move along the idling tracks 73B of the cam grooves 73, but the fitting operation for fitting the female housing 60 and the male housing 130 to each other does not proceed any further. In other words, the fitting completion state is maintained.

Each of the contact pressure applying members 20 has a hook shape as a whole. As shown in FIG. 1, the contact pressure applying member 20 includes a driving portion 22 provided with a driving track 21 that engages with the driving shaft 75 and thereby allows movement in the front-rear direction, a contact pressure applying portion 23 that presses the elastic contact piece 111 of the female terminal 110 and applies contact pressure thereto, and a coupling portion 24 that couples the driving portion 22 and the contact pressure applying portion 23. The driving portion 22 and the contact pressure applying portion 23 are arranged to respectively protrude rearward from two lateral edges of the coupling portion 24 and face each other. The driving portion 22 is longer than the contact pressure applying portion 23.

A flange 25 is provided around the central portion of the driving portion 22 in the front-rear direction. A plurality of attachment holes 26 are provided passing through the flange 25. A plurality of attachment protrusions 31 provided on the first seal 30 are fitted to the attachment holes 26, and thus the first seal 30 is fixed to the rear surface of the flange 25. The driving track 21 is provided in a portion of the driving portion 22 located on the rear side of the flange 25. The driving track 21 extends obliquely forward from the upper edge of the driving portion 22.

As shown in FIG. 5, the driving portions 22 are inserted through holes 67 provided passing through the back wall 62 of the hood portion 61 from the front side. As shown in FIG. 1, the driving portions 22 protruding rearward from the back wall 62 are attached along attachment target portions 68 provided on the left and right sides of the outer circumferential surface of the third seal housing portion 65. Each of the attachment target portions 68 include an L-shaped guide wall 68A for guiding the movement of the driving portion 22. The contact pressure applying member 20 can move in the front-rear direction between a low contact pressure position shown in FIG. 5 and a high contact pressure position shown in FIG. 7. The flange 25 of the contact pressure applying member 20 is accommodated in the gap between the outer circumferential surface of the terminal cover housing portion 64 and the inner circumferential surface of the second seal attachment wall 69. The first seal 30 is in intimate contact with both the outer circumferential surface of the terminal cover housing portion 64 and the inner circumferential surface of the second seal attachment wall 69. Accordingly, the first seals 30 prevent the infiltration of water into the hood portion 61 through the through holes 67.

Figure 9:
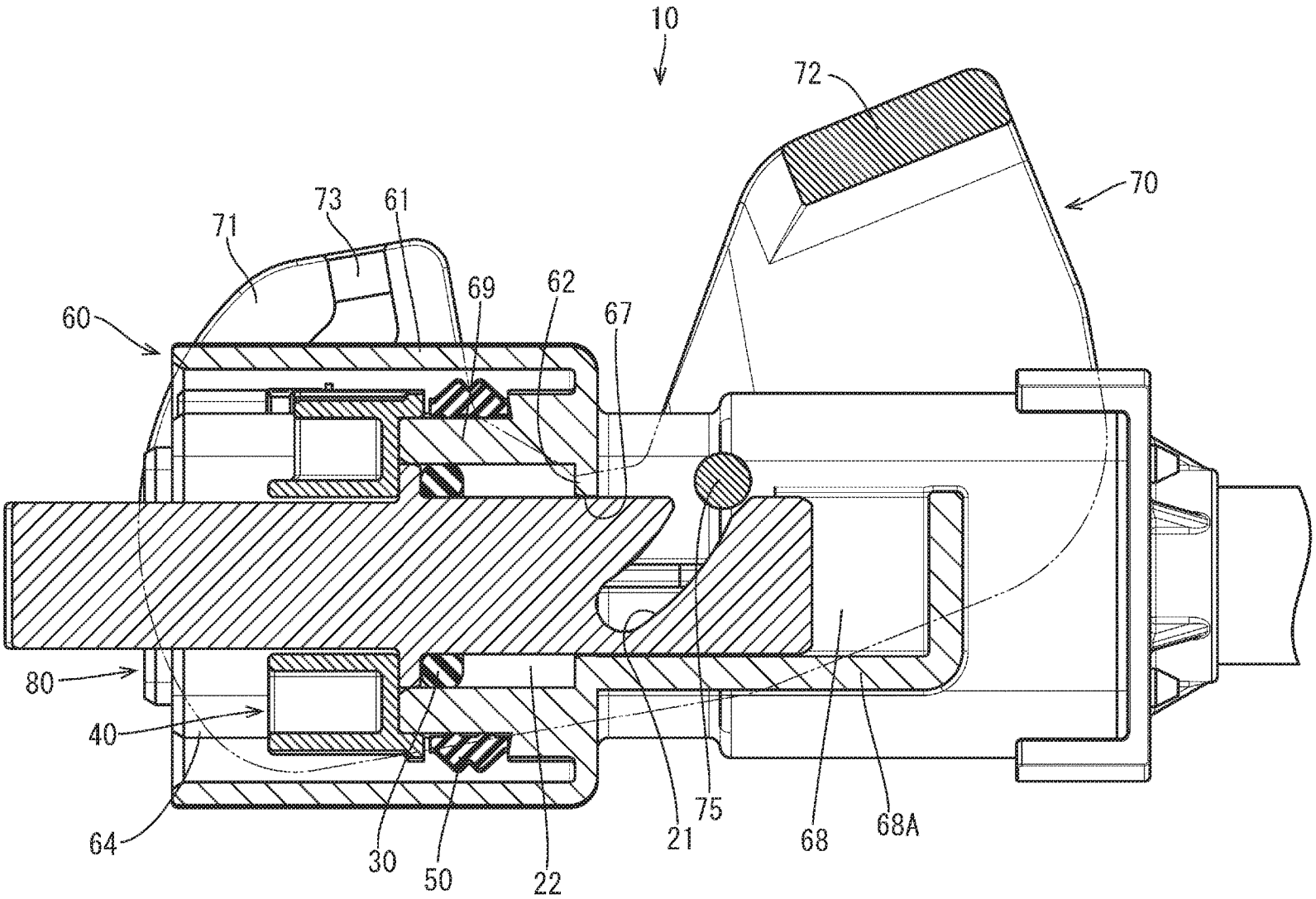
FIG. 9 is a cross-sectional view taken along line C-C in FIG. 8.
Figure 10:
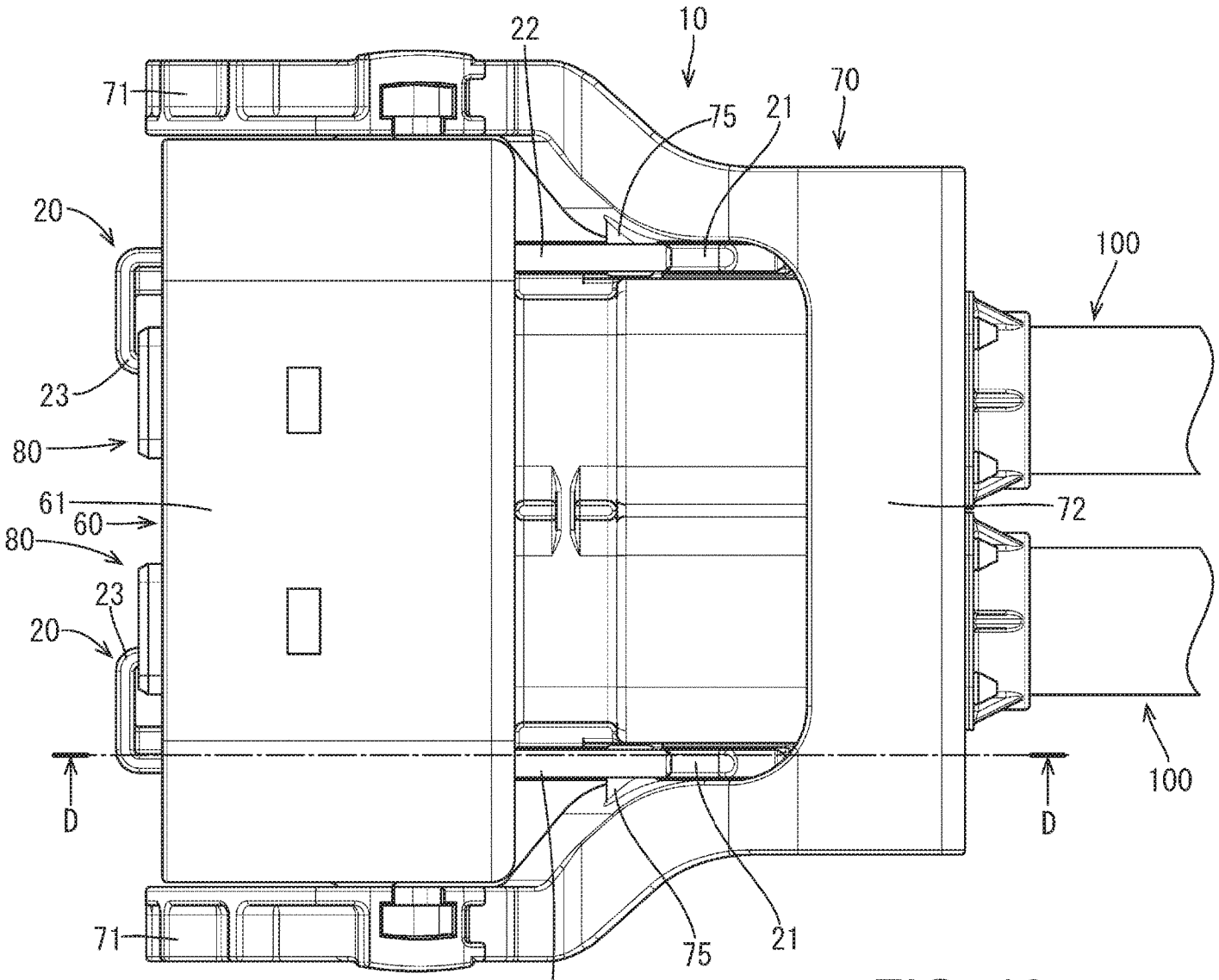
FIG. 10 is a plan view of the lever-type connector, illustrating a state in which the lever is located at a rotation end position.
Figure 11:
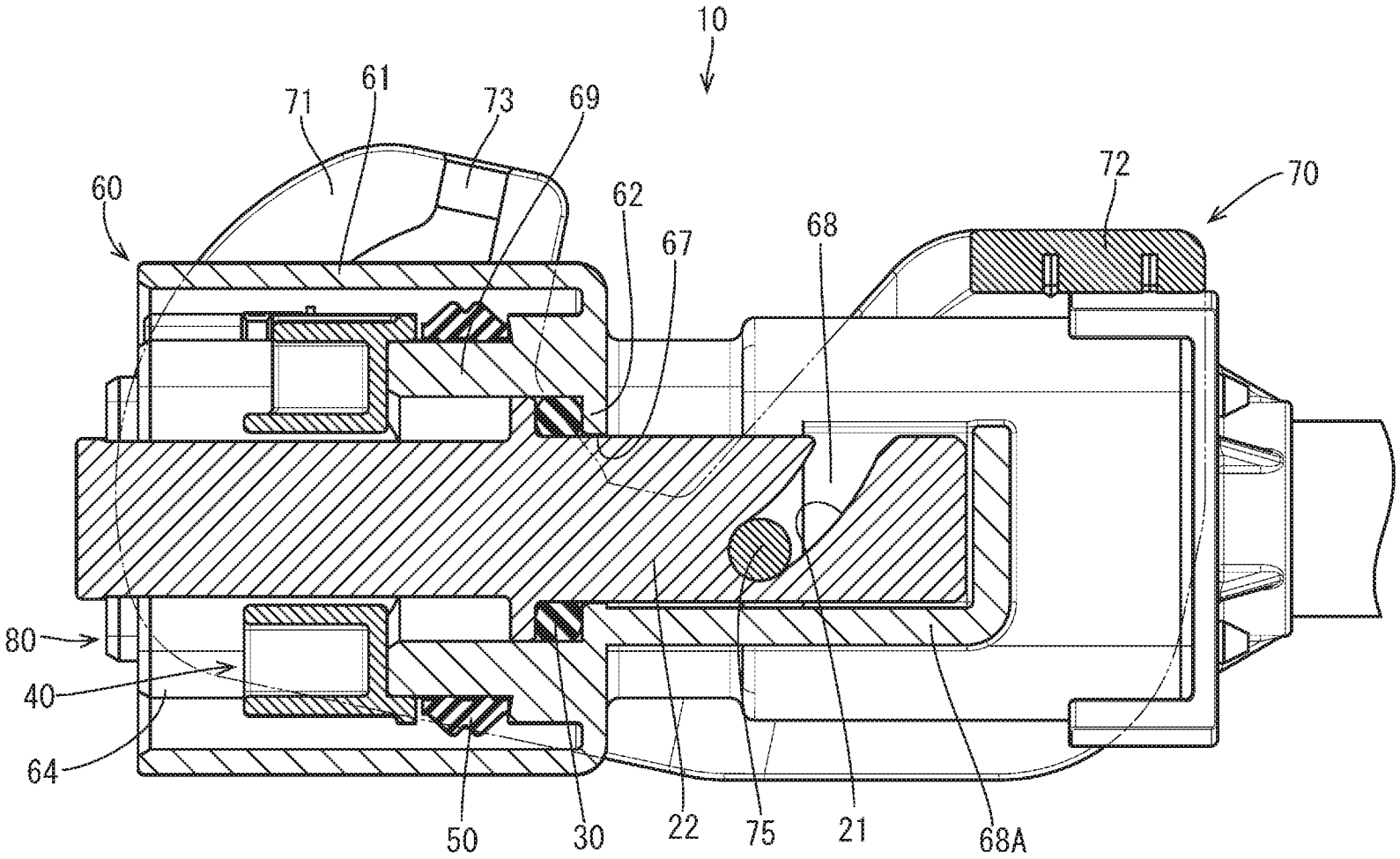
FIG. 11 is a cross-sectional view taken along line D-D in FIG. 10.
Figure 12:
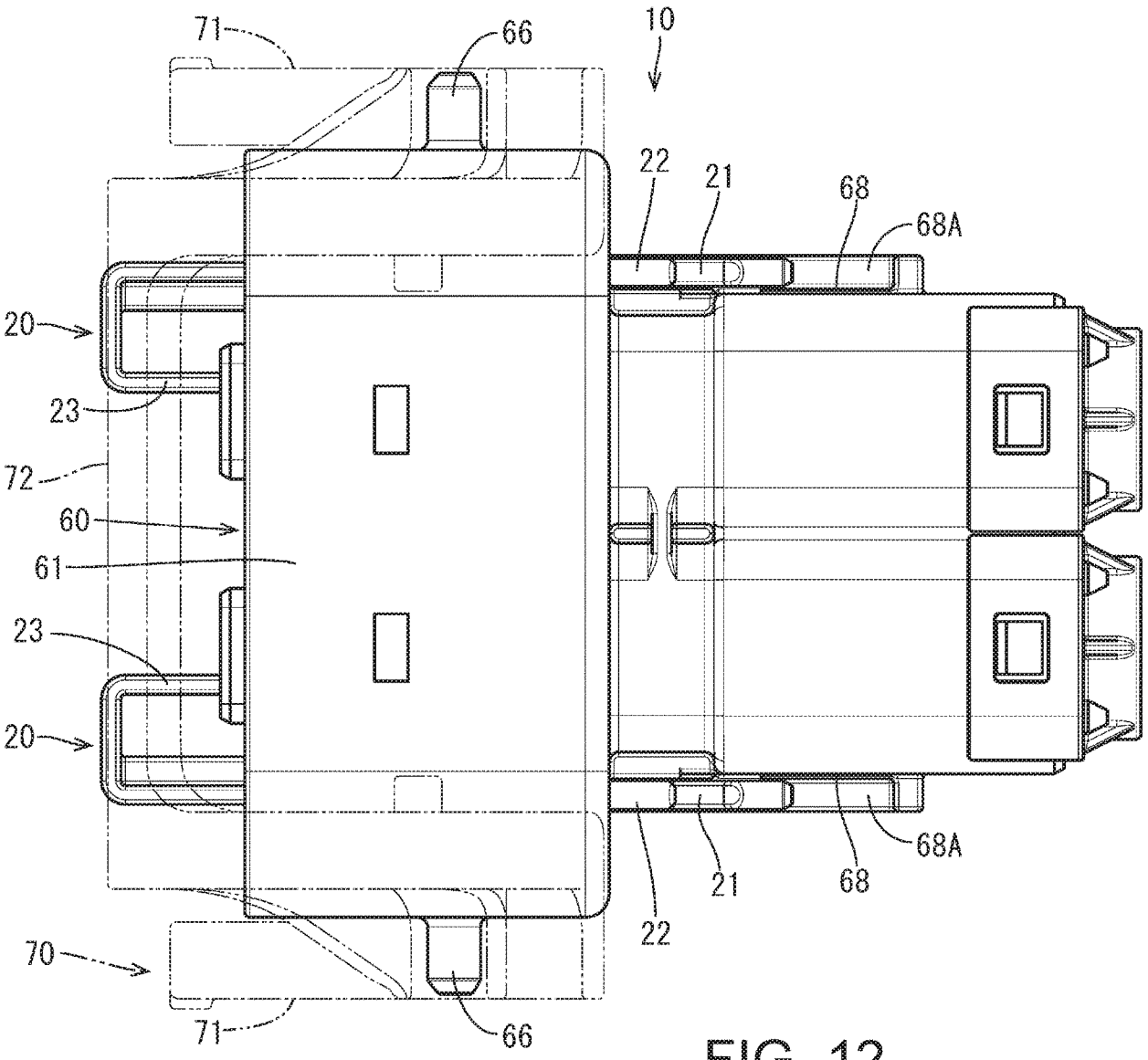
FIG. 12 is a plan view of the lever-type connector in a state in which the lever is removed, and a contact pressure applying member is located at a low contact pressure position.
Figure 13:
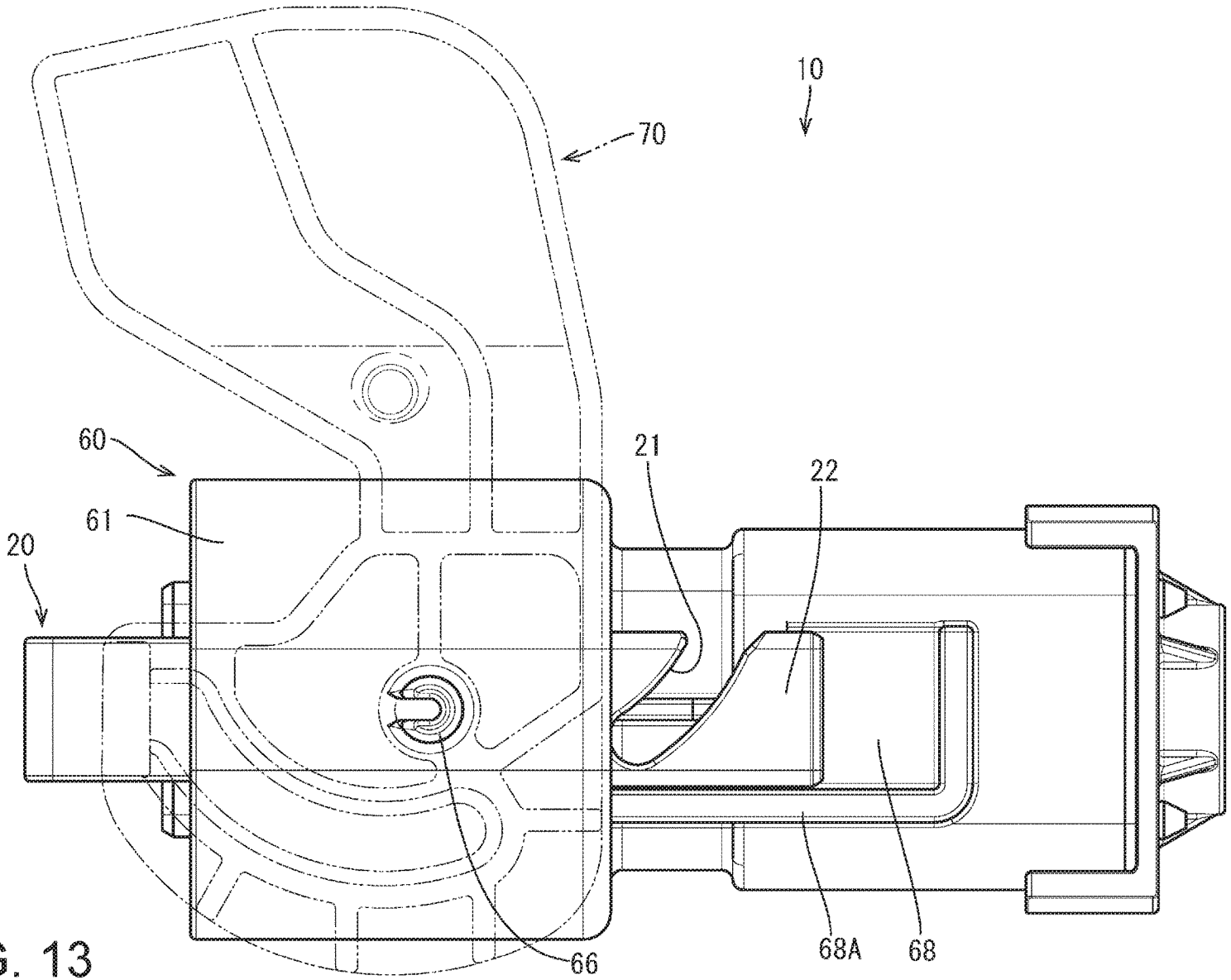
FIG. 13 is a side view of the lever-type connector in a state in which the lever is removed, and the contact pressure applying member is located at the low contact pressure position.

As shown in FIG. 9, when the lever 70 is located at the fitting completion position and the contact pressure applying members 20 are located at the low contact pressure positions, the driving shafts 75 slightly enter the entrance portions of the driving tracks 21 of the contact pressure applying members 20. When the lever 70 is rotated to the rotation end position, the driving shafts 75 move along the driving tracks 21 and thus the driving portions 22 are drawn rearward. As a result, the contact pressure applying members 20 reach the high contact pressure positions as shown in FIG. 11.

Figure 7:
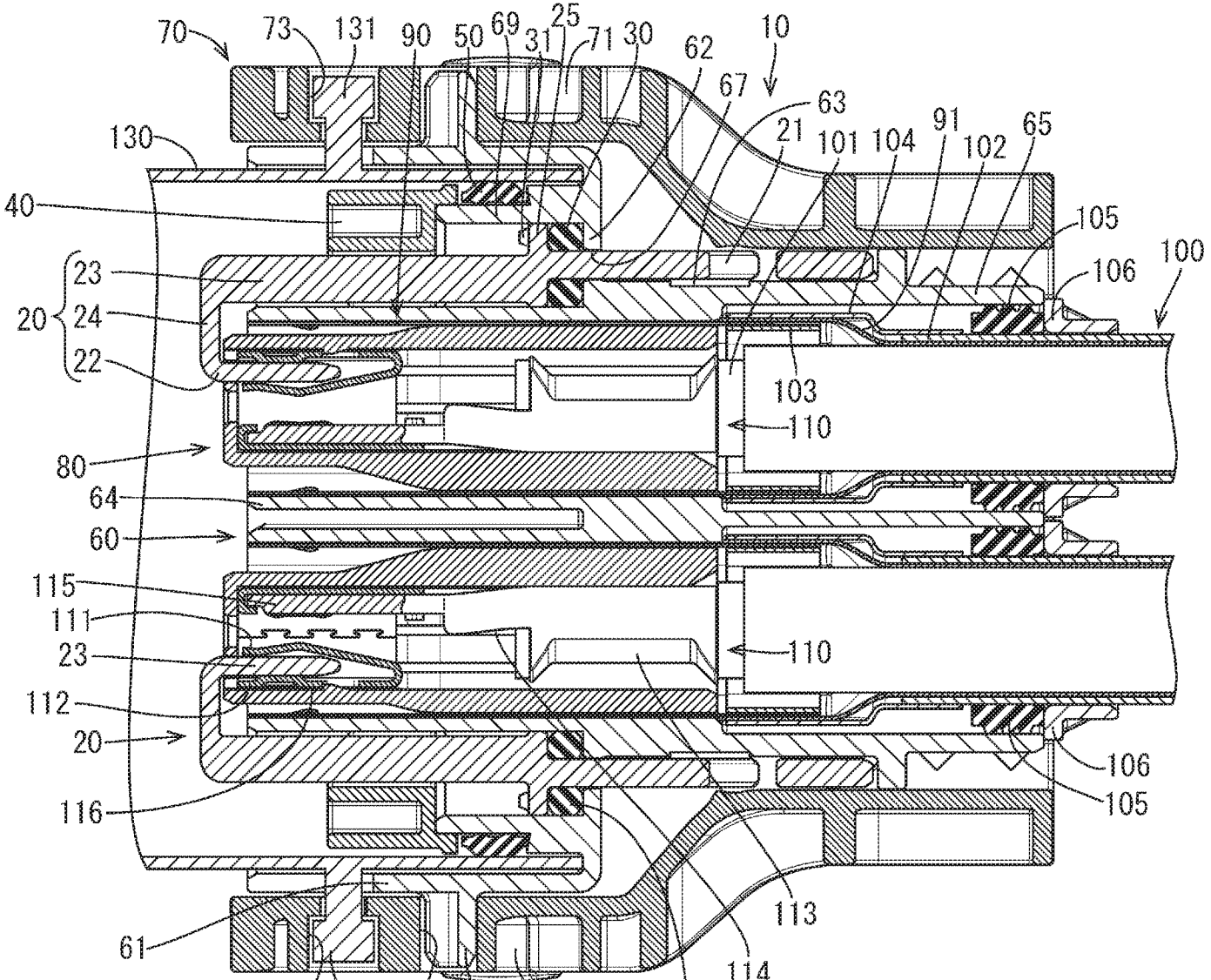
FIG. 7 is a cross-sectional view taken along line B-B in FIG. 6.
Figure 8:
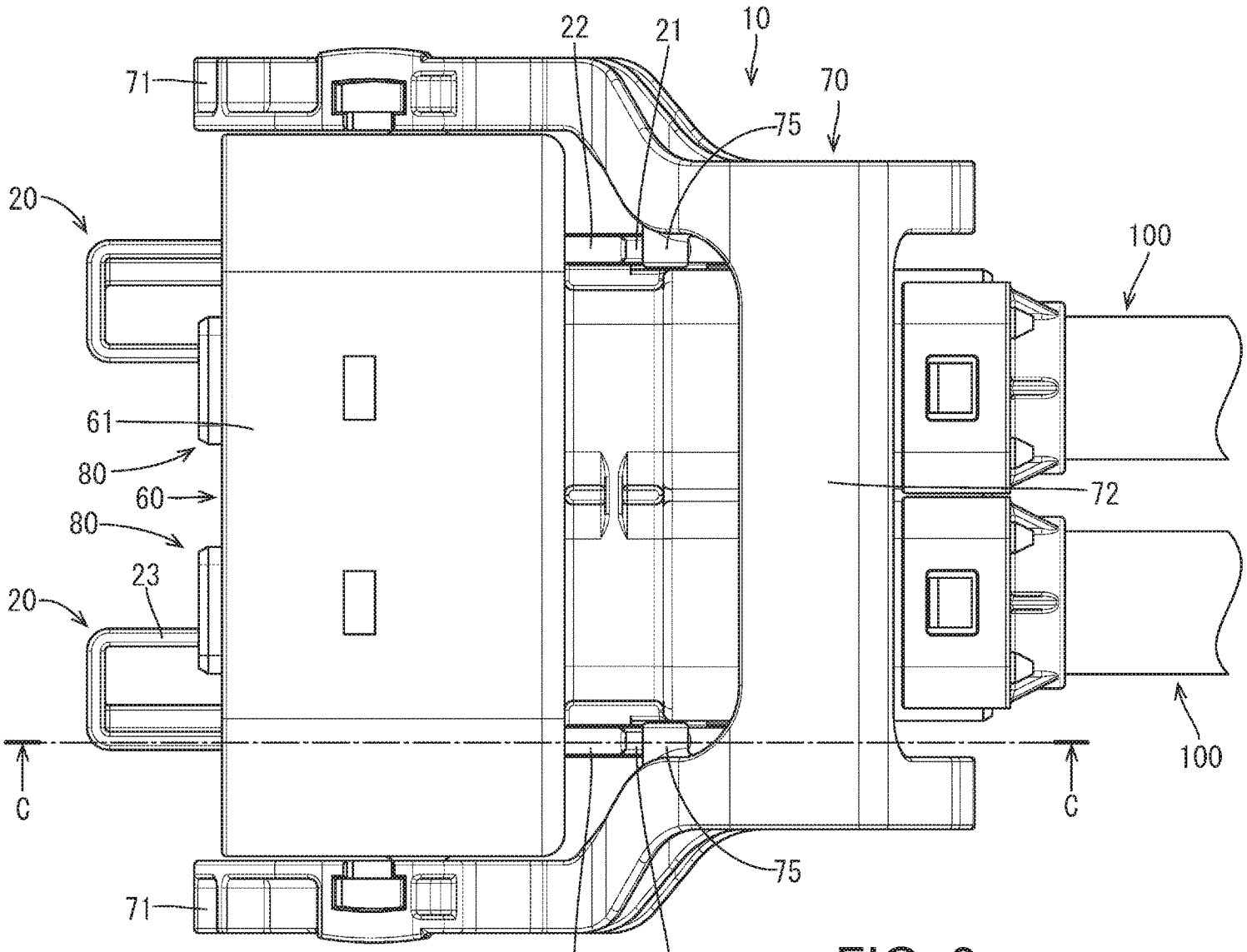
FIG. 8 is a plan view of the lever-type connector, illustrating a state in which the lever is located at a fitting completion position.
Figure 14:
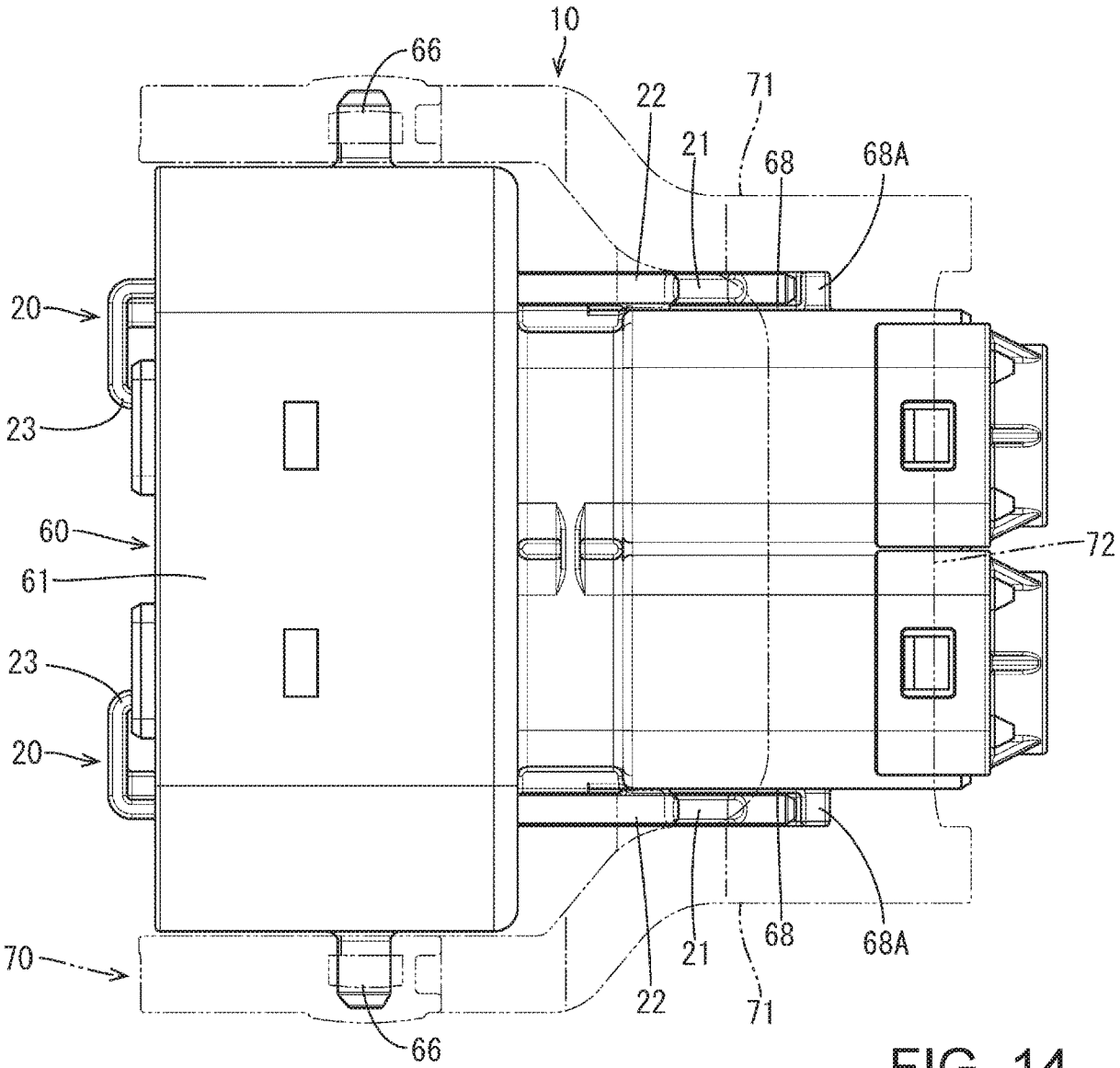
FIG. 14 is a plan view of the lever-type connector in a state in which the lever is removed, and the contact pressure applying member is located at a high contact pressure position.
Figure 15:
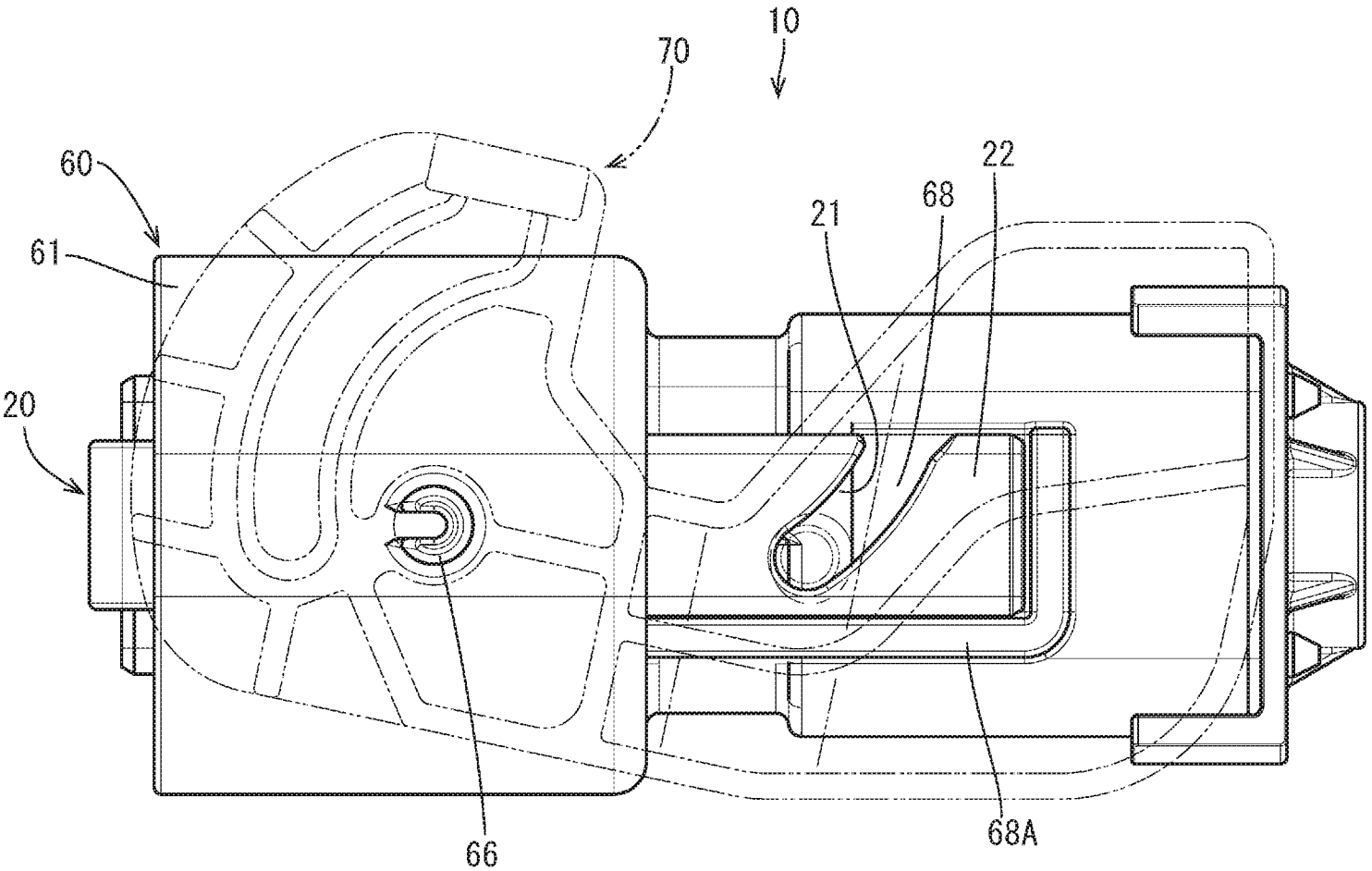
FIG. 15 is a side view of the lever-type connector in a state in which the lever is removed, and the contact pressure applying member is located at the high contact pressure position.

As shown in FIGS. 7 and 14, when the contact pressure applying members 20 are located at the high contact pressure positions, each driving portion 22 is accommodated in the gap between the attachment target portion 68 and the lever 70, thus making it possible to prevent the contact pressure applying members 20 from being deformed and bent outward, and being dislodged from the female housing 60. While the lever 70 is rotated from the fitting completion position to the rotation end position, the cam pins 131 of the male housing 130 move along the idling tracks 73B of the cam grooves 73, and therefore, the fitting operation for fitting the female housing 60 and the male housing 130 to each other does not proceed any further.

Figure 2:
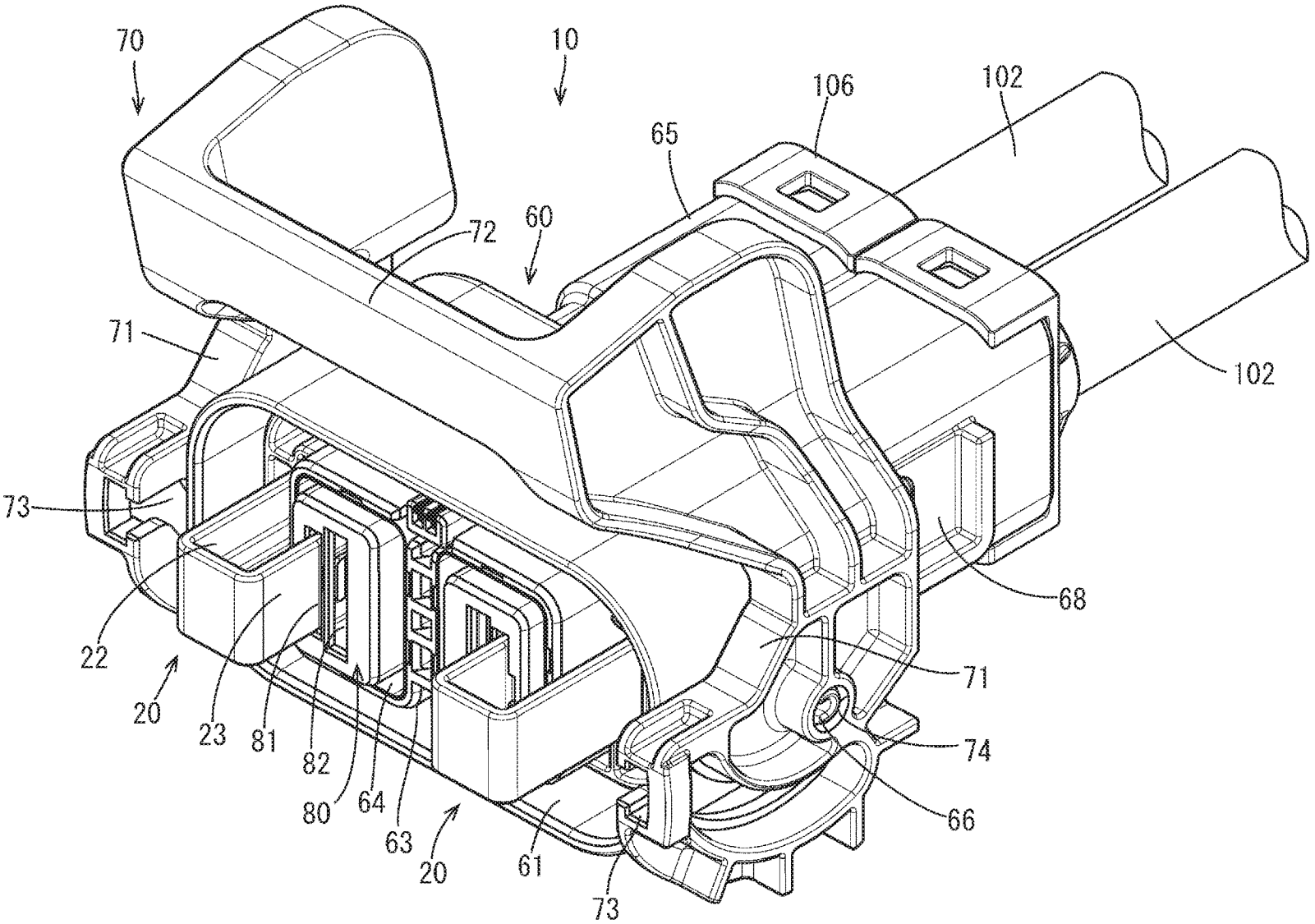
FIG. 2 is a perspective view of the lever-type connector, illustrating a state in which a lever is located at a rotation start position.
Figure 3:
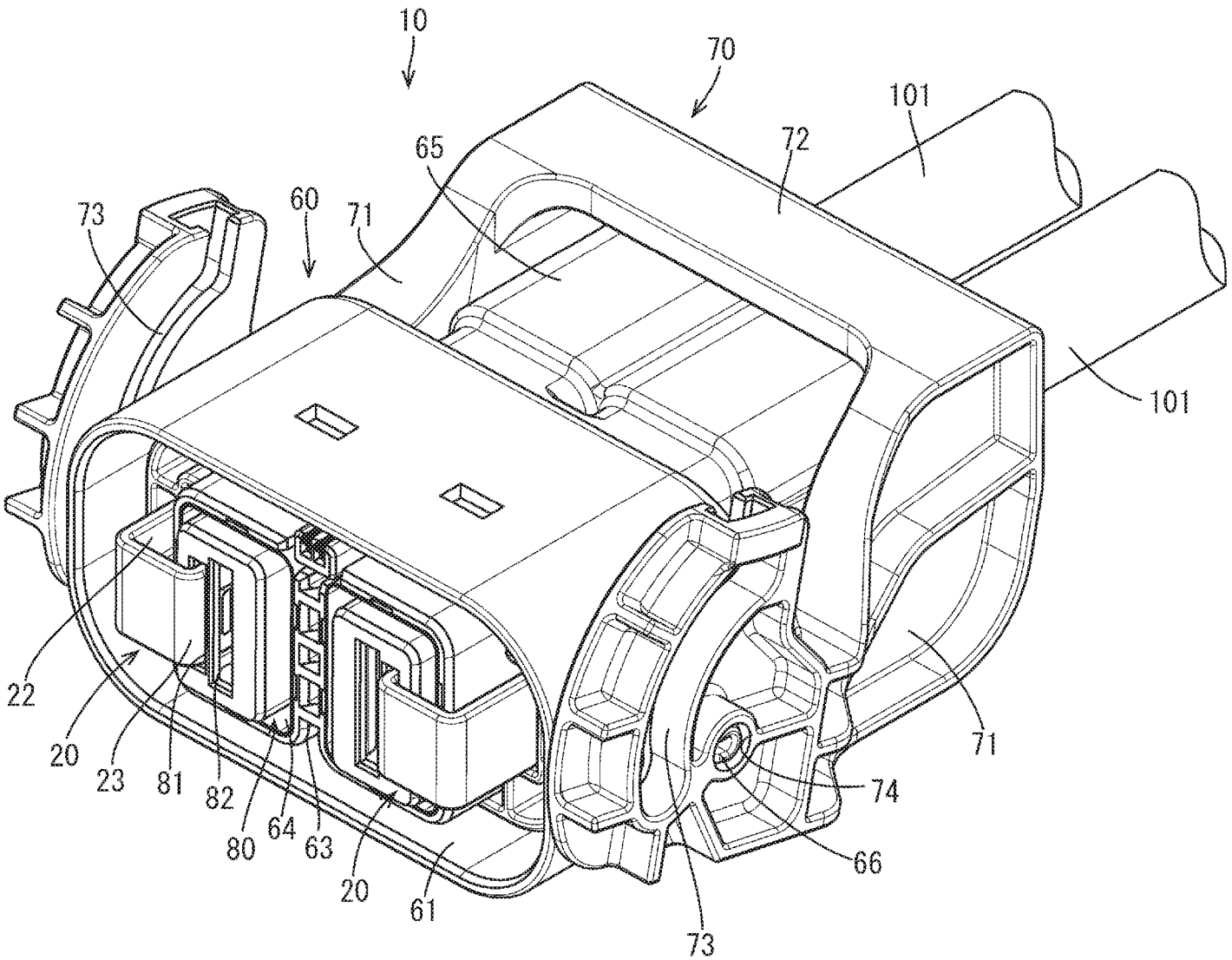
FIG. 3 is a perspective view of the lever-type connector, illustrating a state in which the lever is located at a rotation end position.
Figure 4:
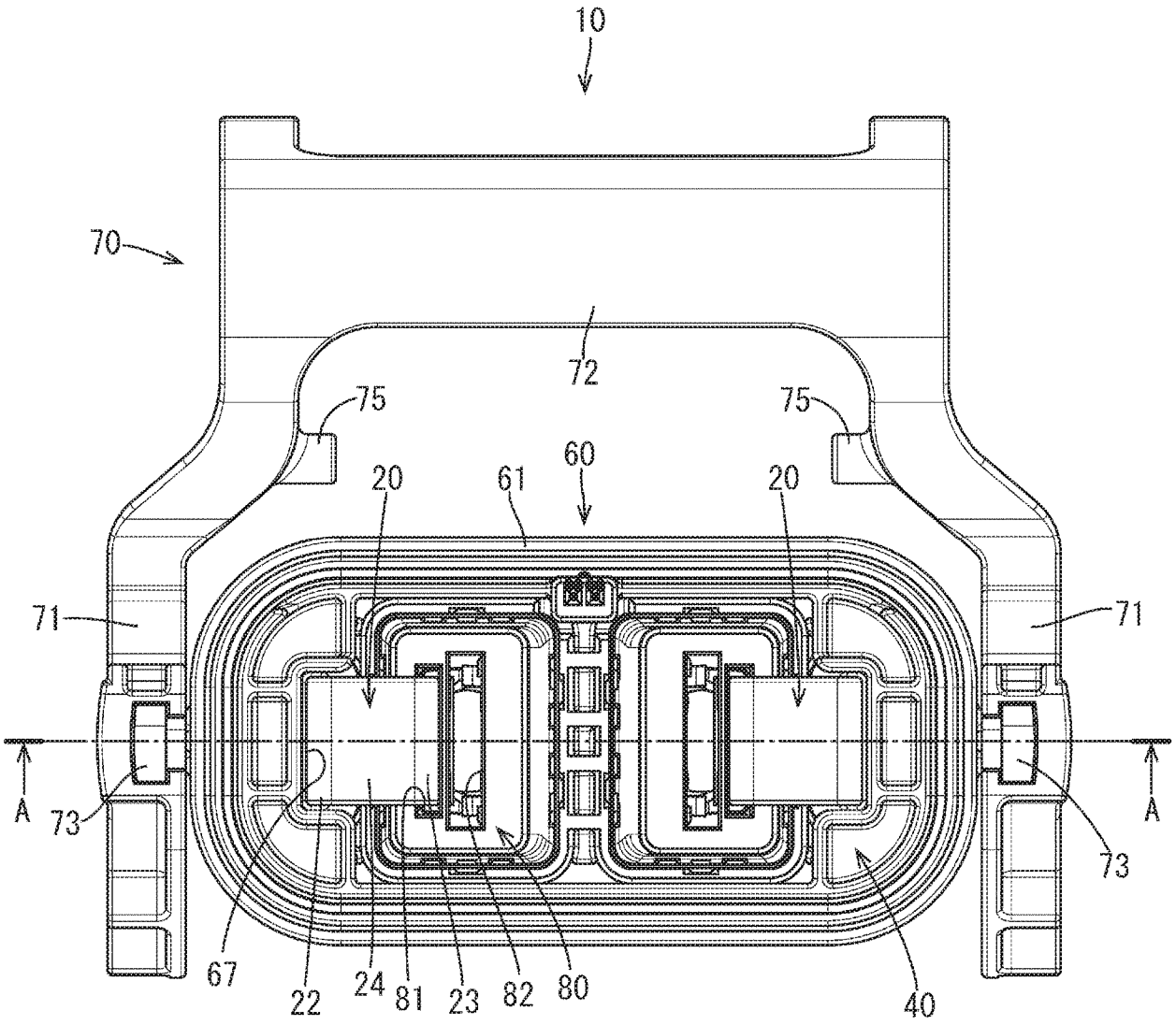
FIG. 4 is a front view of the lever-type connector, illustrating a state in which the lever is located at the rotation start position.

As shown in FIG. 2, each of the front end portions of the terminal covers 80 is provided with a contact pressure applying portion insertion hole 81 through which the contact pressure applying portion 23 can be inserted from the front side, and a male terminal insertion hole 82 through which the male terminal 120 can be inserted from the front side. As shown in FIG. 5, at the low contact pressure position, each of the leading ends of the contact pressure applying portions 23 passes through the contact pressure applying portion insertion hole 81 and enters the rear side of the elastic contact piece 111 (a position located on a side opposite to the terminal connecting portion 115). As shown in FIG. 7, at the high contact pressure position, the contact pressure applying portion 23 pushes the elastic contact piece 111 toward the terminal connecting portion 115 while coming into sliding contact with the rear side of the leading end of the elastic contact piece 111, and thus the contact pressure applying portion 23 presses the elastic contact piece 111 toward the terminal connecting portion 115.

Figure 19:
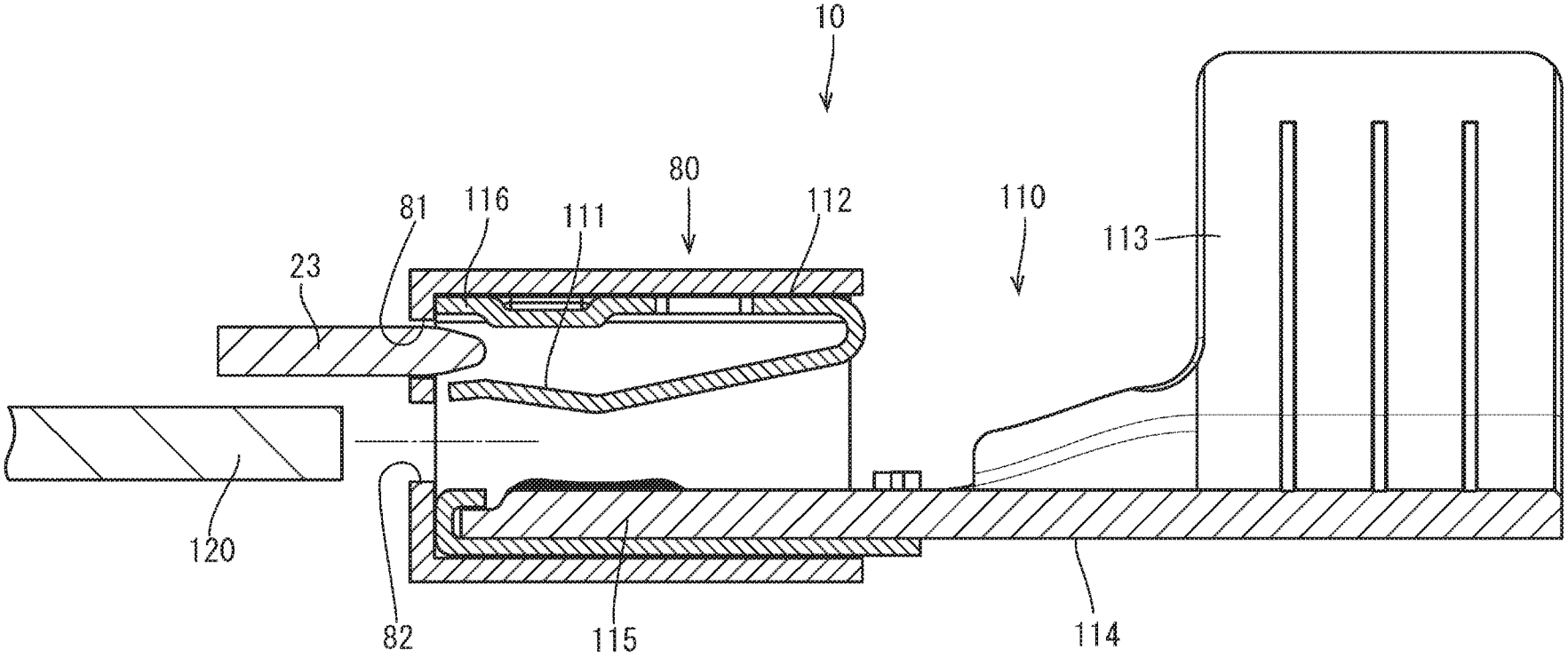
FIG. 19 is a cross-sectional view illustrating a state in which a male terminal has not been connected to a female terminal yet.
Figure 20:
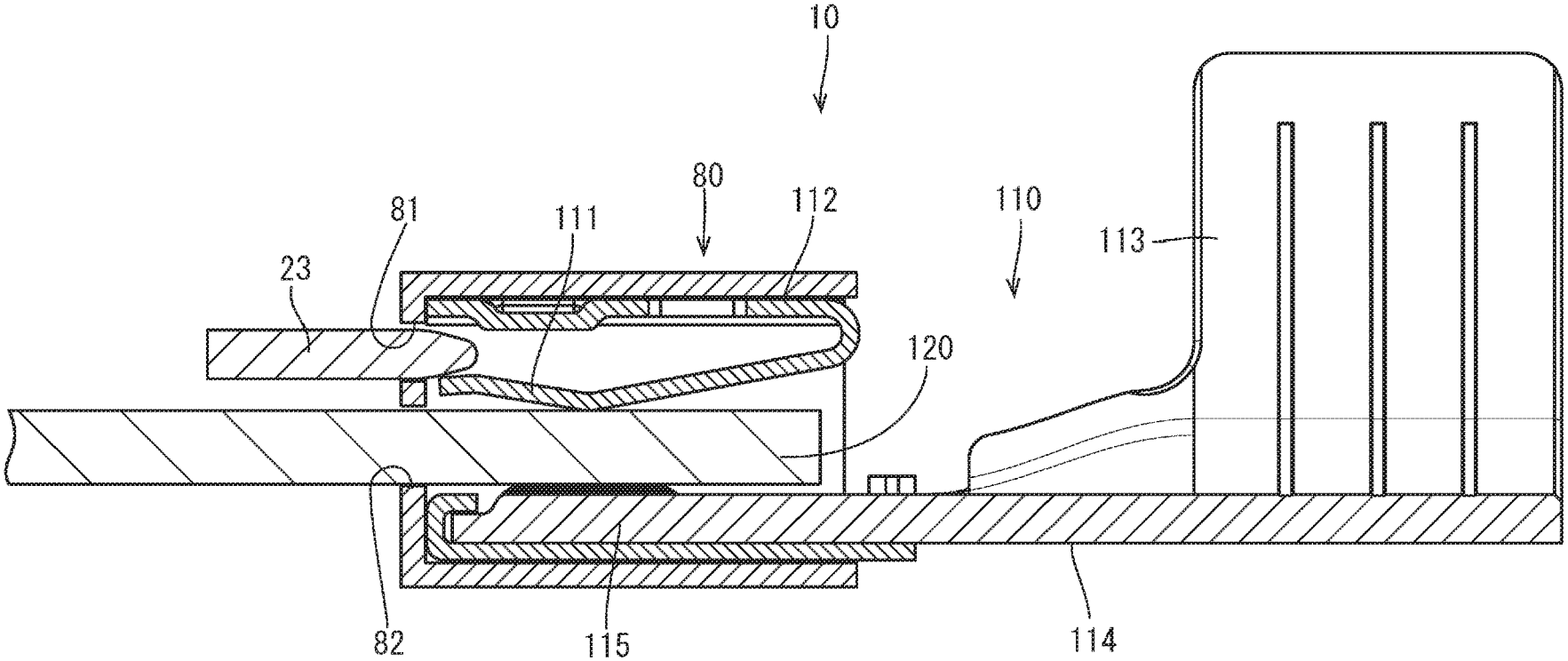
FIG. 20 is a cross-sectional view illustrating a state in which the male terminal is connected to the female terminal, and the contact pressure applying member is located at the low contact pressure position.
Figure 21:
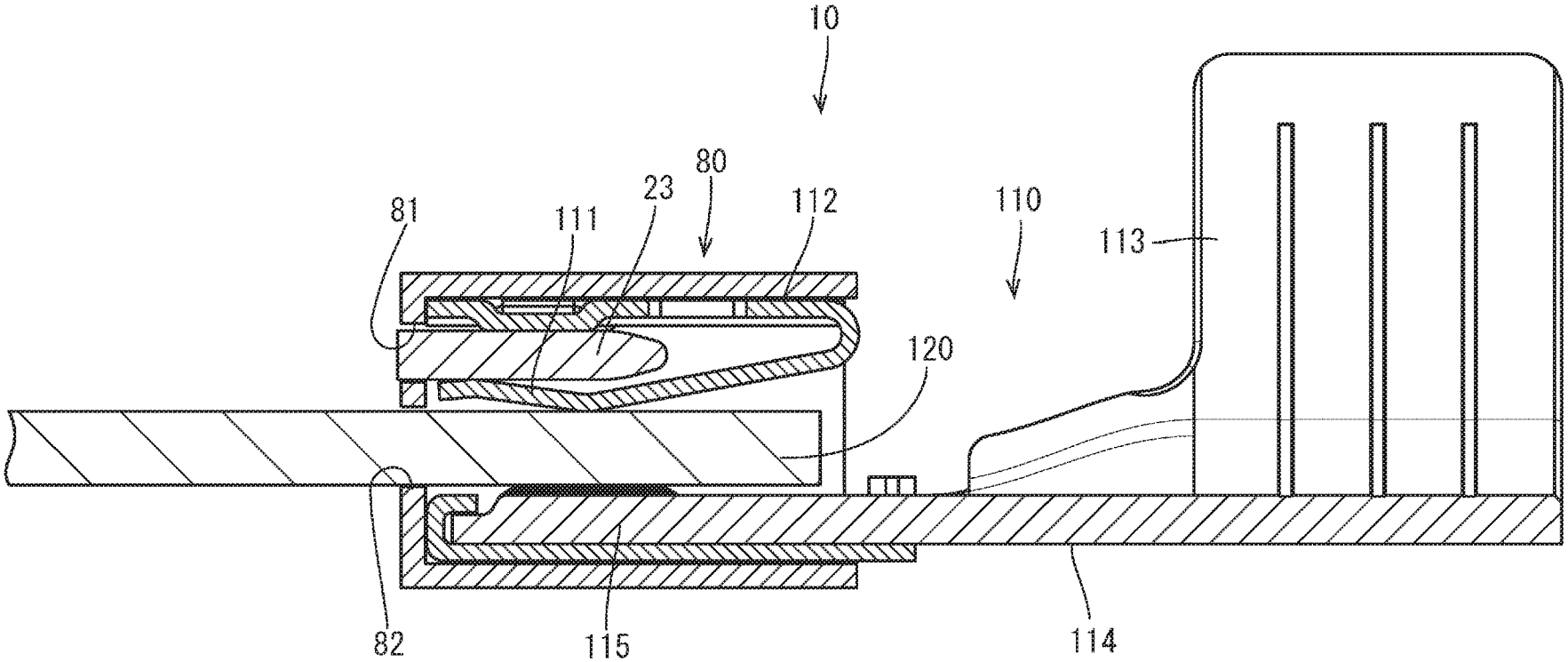
FIG. 21 is a cross-sectional view illustrating a state in which the male terminal is connected to the female terminal, and the contact pressure applying member is located at the high contact pressure position.

Specifically, as shown in FIG. 19, when the male terminal 120 enters the gap between the elastic contact piece 111 and the terminal connecting portion 115 through the male terminal insertion hole 82 in the state in which the contact pressure applying portion 23 is located at the low contact pressure position, the male terminal 120 comes into contact with the terminal connecting portion 115 with low contact pressure due to spring force of the elastic contact piece 111 as shown in FIG. 20. Accordingly, contact wear does not occur in the male terminal 120 and the terminal connecting portion 115, and a foreign matter removing effect obtained through a wiping effect is exhibited. Then, as shown in FIG. 21, in the state in which the contact pressure applying portion 23 is located at the high contact pressure position, the male terminal 120 comes into contact with the terminal connecting portion 115 with high contact pressure due to pressing force from the contact pressure applying portion 23 via the elastic contact piece 111. With this configuration, high contact pressure can be applied to the male terminal 120 and the terminal connecting portion 115 while the fitting operation for fitting the female housing 60 and the male housing 130 to each other remains completely stopped, thus making it possible to reduce electrical contact resistance with high contact pressure without causing contact wear.

As described above, in this embodiment, before the female housing 60 and the male housing 130 are completely fitted to each other, the contact pressure applying member 20 is located at the low contact pressure position, and the female terminal 110 is in contact with the male terminal 120 with low contact pressure, thus making it possible to prevent contact wear. After the female housing 60 and the male housing 130 are completely fitted to each other, the contact pressure applying member 20 is moved to the high contact pressure position by the lever 70, and thus the female terminal 110 is in contact with the male terminal 120 with high contact pressure. During this period, the fitting operation for fitting the female housing 60 and the male housing 130 to each other remains stopped, thus making it possible to prevent contact wear even when the low contact pressure state changes to the high contact pressure state.

The through holes 67 of the female housing 60 can be sealed from water with the first seals 30, and the fitting portion where the female housing 60 and the male housing 130 are fitted to each other can be sealed from water with the second seal 50, thus making it possible to apply the lever-type connector to a waterproof connector.

A configuration may also be employed in which the lever 70 includes the cam grooves 73, and each of the cam grooves 73 includes: the fitting track 73A configured to be engaged with the cam pin 131 provided on the male housing 130 and to thereby allow a fitting operation to be performed; and the idling track 73B configured to allow the fitting operation to remain stopped when the lever 70 is continuously moved after the completion of fitting.

With this configuration, each of the cam grooves 73 includes the fitting track 73A and the idling track 73B, and therefore, the fitting operation does not proceed even when the lever 70 is continuously moved after the female housing 60 and the male housing 130 are completely fitted to each other using the fitting track 73A, thus making it possible to maintain the female housing 60 and the male housing 130 in the state in which they are completely fitted to each other.

A configuration may also be employed in which the lever 70 includes the driving shafts 75, each of the contact pressure applying members 20 includes: the driving portion 22 provided with the driving track 21 configured to be engaged with the driving shaft 75 and to thereby allow movement from the low contact pressure position to the high contact pressure position; and the contact pressure applying portion 23 configured to press the female terminal 110 and apply contact pressure, and the driving portion 22 is provided passing through the through hole 67.

With this configuration, the driving portions 22 are arranged at positions separate from the positions of the contact pressure applying portions 23 that press the female terminals 110, thus making it possible to provide the first seals 30 without being limited by the arrangement of the female terminals 110.

A configuration may also be employed in which the female housing 60 includes the attachment target portions 68 to which the driving portions 22 are attached, and each of the driving portions 22 is accommodated in a gap between the attachment target portion 68 and the lever 70 after the female housing 60 and the male housing 130 are completely fitted to each other.

With this configuration, each of the driving portions 22 is accommodated in the gap between the attachment target portion 68 and the lever 70, thus making it possible to prevent the driving portion 22 from becoming dislodged from the attachment target portion 68 while the driving portion 22 is moving from the low contact pressure position to the high contact pressure position.

Embodiment 2

Figure 23:
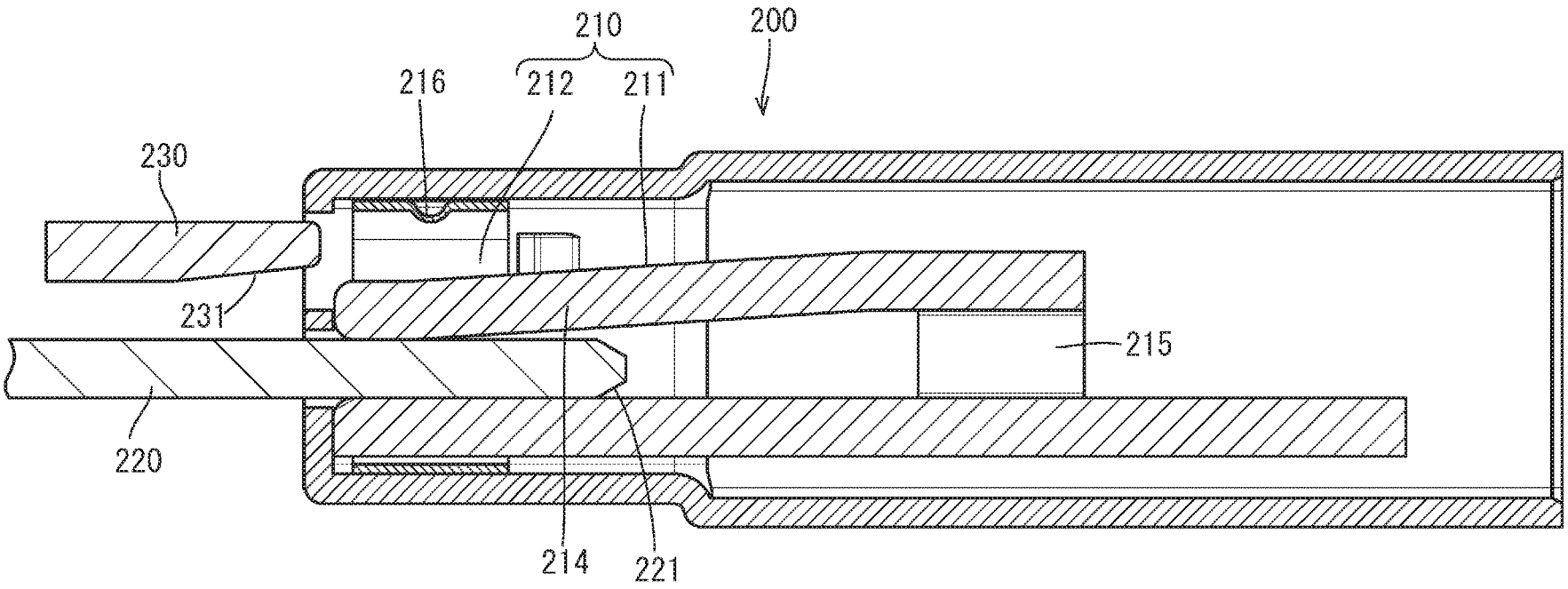
FIG. 23 is a cross-sectional view illustrating a state in which the male terminal is connected to the female terminal, and a contact pressure applying member is located at a low contact pressure position in Embodiment 2.
Figure 24:
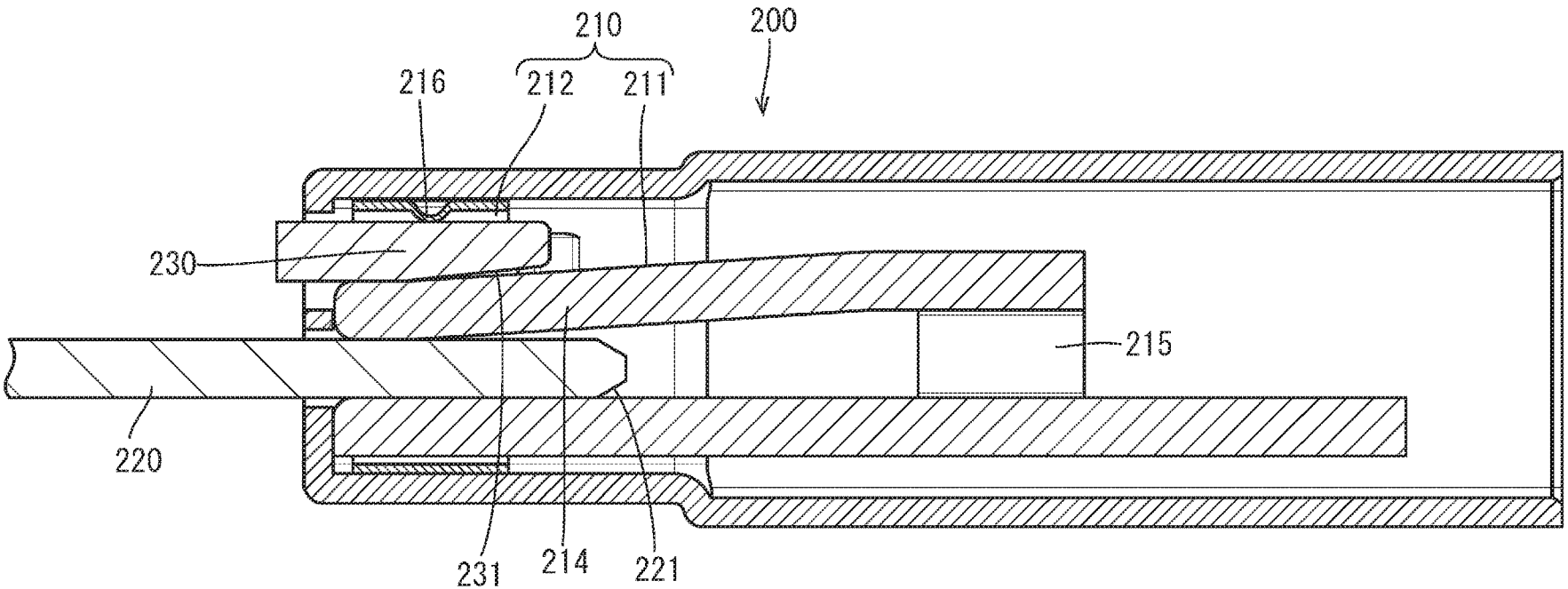
FIG. 24 is a cross-sectional view illustrating a state in which the male terminal is connected to the female terminal, and the contact pressure applying member is located at a high contact pressure position in Embodiment 2.

Next, Embodiment 2 will be described with reference to the diagrams shown in FIGS. 22 to 24. A lever-type connector 200 of this embodiment is different from the lever-type connector 10 of Embodiment 1 in that the configuration of the female terminal 110 is changed. The other configurations are the same as those in Embodiment 1, and therefore, the same reference numerals as those in Embodiment 1 are used, and the descriptions of these configurations are omitted.

Figure 22:
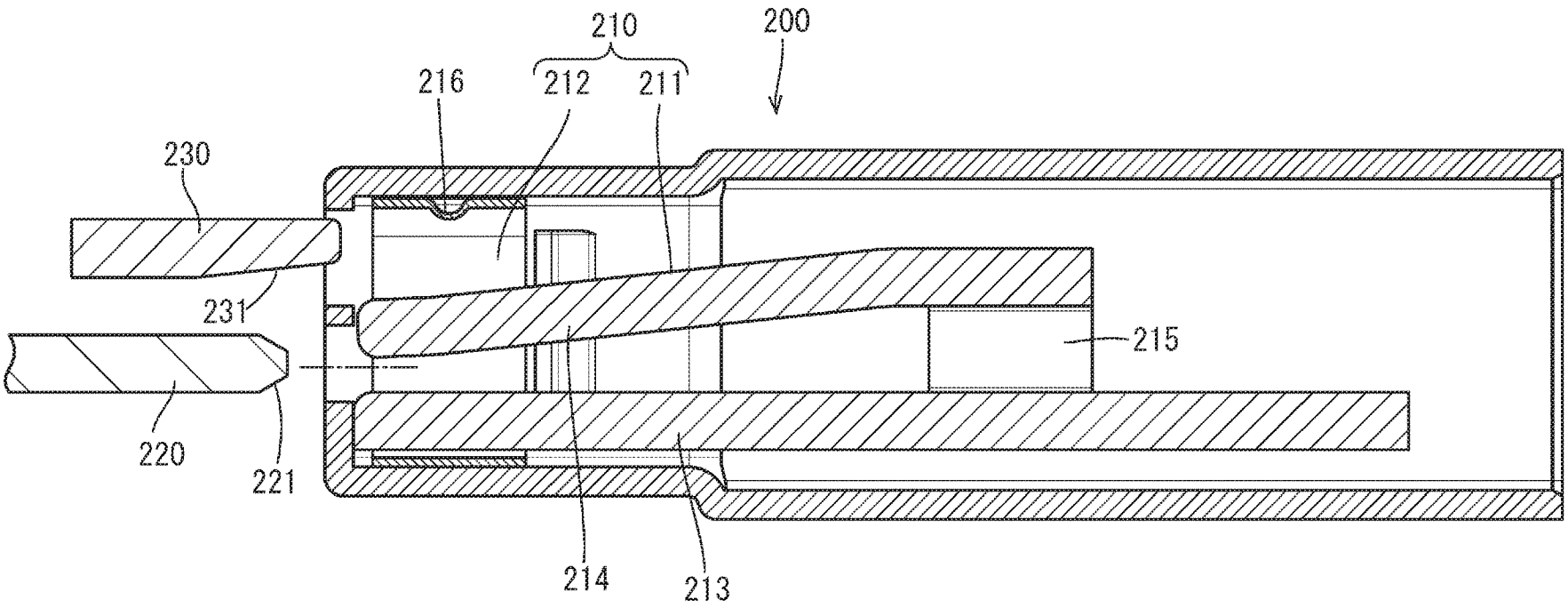
FIG. 22 is a cross-sectional view illustrating a state in which a male terminal has not been connected to the female terminal yet in Embodiment 2.

As shown in FIG. 22, a female terminal 210 of this embodiment includes a terminal main body 211 and a secondary spring 212, and the terminal main body 211 includes a bottom wall 213, a primary spring 214 arranged opposite to the bottom wall 213, and two coupling walls 215 that couple the bottom wall 213 and the primary spring 214. The primary spring 214 is formed such that it approaches the bottom wall 213 as it extends forward from the front edge of the base end portion that is installed at the upper edge of the two coupling walls 215, and the front end of the primary spring 214 is substantially aligned with the front end of the bottom wall 213 in the front-rear direction.

The secondary spring 212 has a polygonal tube shape, and is arranged so as to surround the entire periphery of the vicinity of the front end of the primary spring 214 and the vicinity of the front end of the bottom wall 213. The opposed wall portion of the secondary spring 212 that is opposite to the primary spring 214 is provided with a protrusion 216. The distance between the front end of the primary spring 214 and the bottom wall 213 is made smaller than the thickness of a male terminal 220. However, a guiding tapered portion 221 is formed at the front end of the male terminal 220, thus making it possible to smoothly insert the male terminal 220 into the gap between the bottom wall 213 and the primary spring 214. As shown in FIG. 23, when the male terminal 220 enters the gap between the bottom wall 213 and the primary spring 214 in the state in which the contact pressure applying portion 23 is located at the low contact pressure position, contact pressure is generated due to the primary spring 214 being bent. Accordingly, the male terminal 220 and the female terminal 210 are in contact with each other with low contact pressure, and a foreign matter removing effect obtained through a wiping effect is exhibited without causing contact wear.

Since the guiding tapered portion 231 is formed at the front end of a contact pressure applying portion 230, the contact pressure applying portion 230 can be smoothly inserted into the gap between the secondary spring 212 and the primary spring 214, and contact pressure can be softly applied to the primary spring 214. As shown in FIG. 24, when the contact pressure applying portion 230 is moved from the low contact pressure position to the high contact pressure position, the contact pressure applying portion 230 is thrust into the gap between the protrusion 216 and the primary spring 214, and the contact pressure applying portion 230 presses the primary spring 214 toward the bottom wall 213. In this state, the male terminal 220 is in contact with the bottom wall 213 with high contact pressure due to pressing force from the contact pressure applying portion 230 via the primary spring 214. With this configuration, high contact pressure can be applied to the male terminal 220 and the female terminal 210 while the fitting operation for fitting the female housing 60 and the male housing 130 to each other remains completely stopped, thus making it also possible to reduce electrical contact resistance with high contact pressure without causing contact wear.

Embodiment 3

Figure 25:
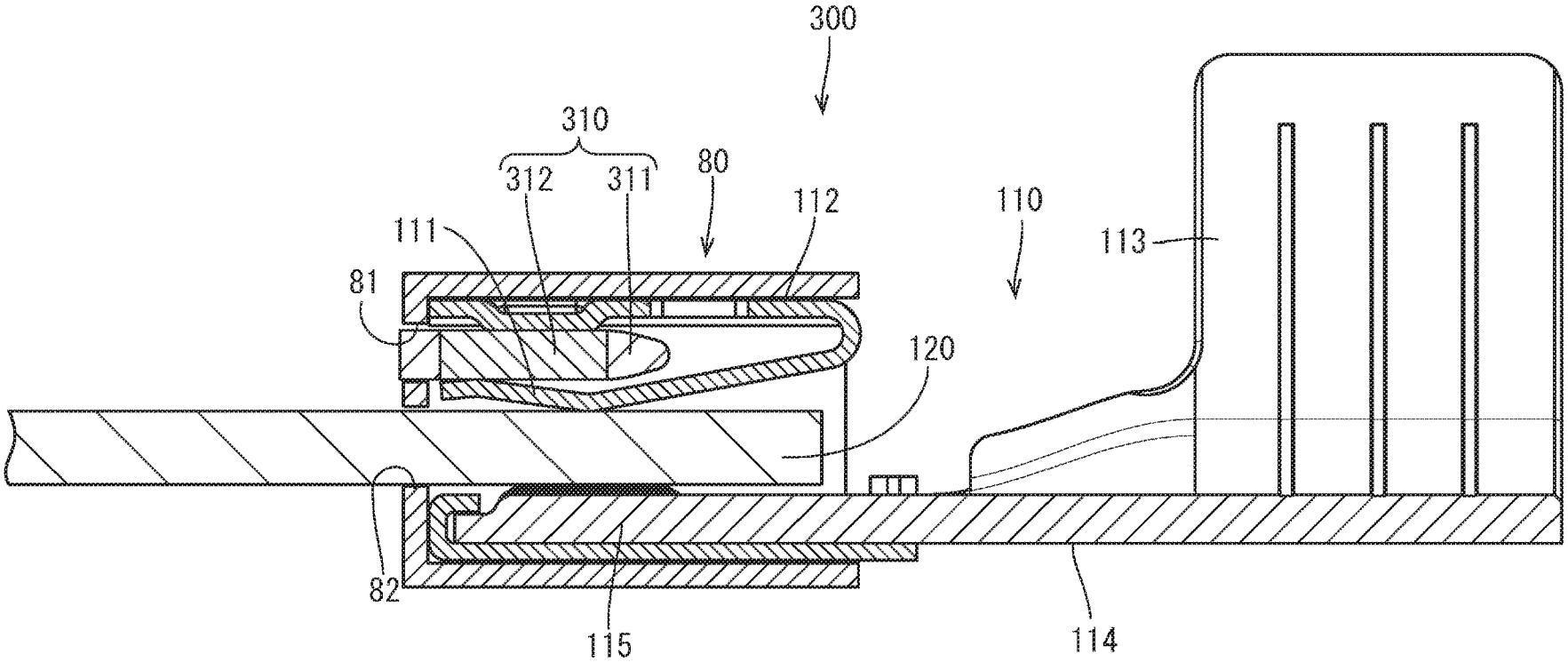
FIG. 25 is a cross-sectional view illustrating a state in which a male terminal is connected to a female terminal, and a contact pressure applying member is located at a high contact pressure position in Embodiment 3.

Next, Embodiment 3 will be described with reference to the diagram shown in FIG. 25. A lever-type connector 300 of this embodiment is different from the lever-type connector 10 of Embodiment 1 in that the configuration of the contact pressure applying portion 23 is changed. The other configurations are the same as those in Embodiment 1, and therefore, the same reference numerals as those in Embodiment 1 are used, and the descriptions of these configurations are omitted.

The contact pressure applying portion 310 of this embodiment includes a shaft portion 311 made of synthetic resin and a spike 312 made of metal. The spike 312 is formed such that the leading end of the elastic contact piece 111 is in contact with the spike 312 while the contact pressure applying portion 310 moves between the low contact pressure position and the high contact pressure position.

While the contact pressure applying portion 310 moves from the low contact pressure position to the high contact pressure position, the leading end portion of the elastic contact piece 111 comes into sliding contact with the spike 312 with strong force. However, the spike 312 is made of metal and is not worn away unlike in a case where the spike is made of resin even when the contact pressure applying portion 310 is repeatedly inserted and removed. Moreover, even if a strong force is applied thereto from the elastic contact piece 111 for a long period of time in the state in which the contact pressure applying portion 310 is located at the high contact pressure position, compressive creep deformation does not occur unlike in a case where the spike is made of resin. Therefore, a reduction in contact pressure due to wear and compressive creep deformation can be prevented.

Embodiment 4

Figure 26:
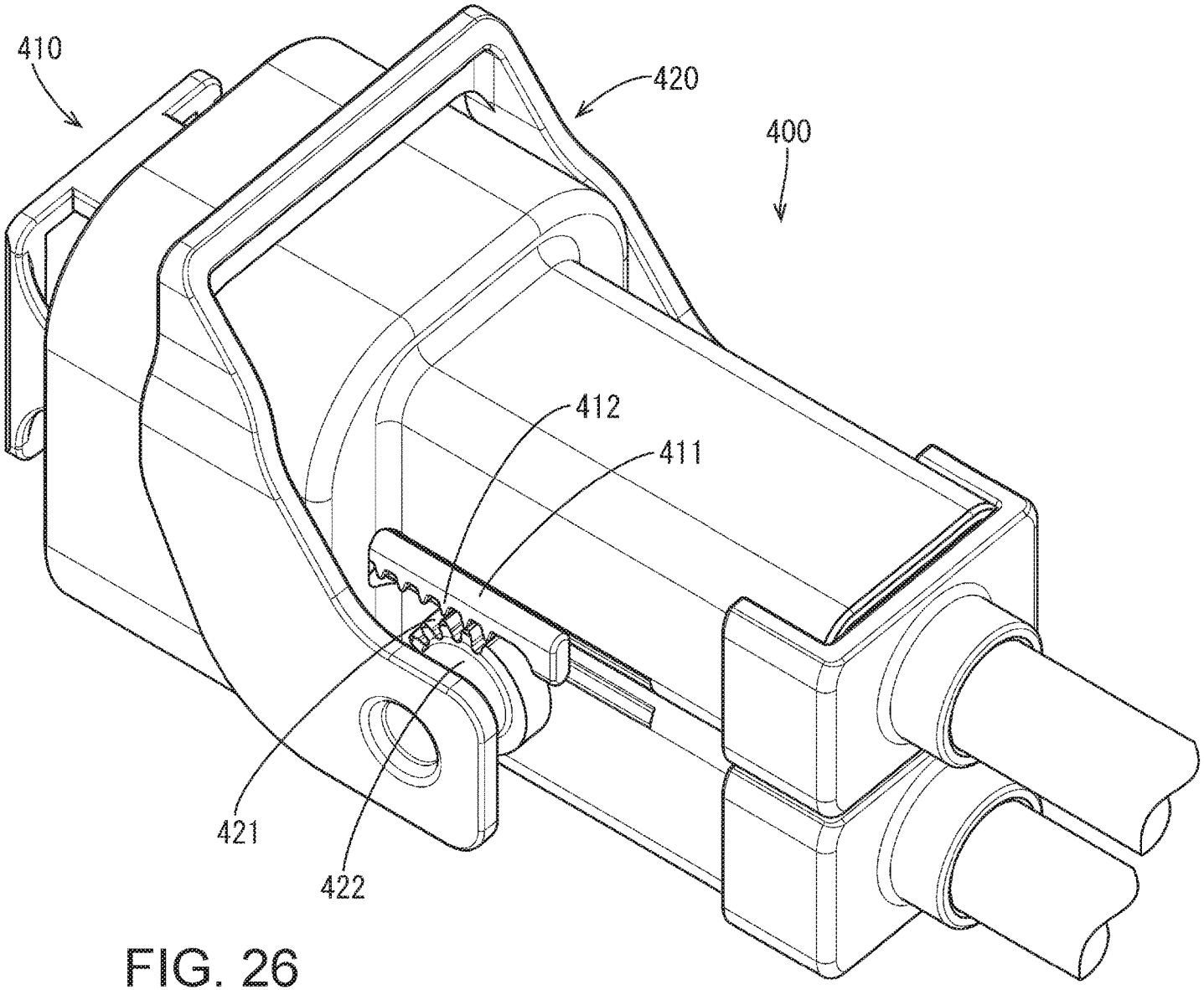
FIG. 26 is a perspective view illustrating a state in which a contact pressure applying member is moved by gear drive in Embodiment 4.

Next, Embodiment 4 will be described with reference to the diagram shown in FIG. 26. A lever-type connector 400 of this embodiment is different from the lever-type connector 10 of Embodiment 1 in that the drive system for the contact pressure applying member 20 is changed from a cam mechanism to a rack-and-pinion gear drive. The other configurations are the same as those in Embodiment 1, and therefore, the same reference numerals as those in Embodiment 1 are used, and the descriptions of these configurations are omitted.

A contact pressure applying member 410 of this embodiment includes a driving portion 412 provided with a driving gear 411 instead of the driving track 21. The driving gear 411 extends linearly. On the other hand, a lever 420 includes a rotation shaft 422 provided with a pinion gear 421 on the outer circumference. The driving gear 411 and the pinion gear 421 mesh with each other, and the contact pressure applying member 410 can be moved in the front-rear direction by rotating the lever 420.

Other Embodiments

The technology disclosed in this specification is not limited to the embodiments described in the description above and the drawings, and for example, various embodiments below are also included.

(1) Although the lever 70 is provided with the cam grooves 73, and the male housing 130 is provided with the cam pins 131 in the above-mentioned embodiments, a configuration may also be employed in which a lever is provided with cam pins, and a male housing is provided with cam grooves.

(2) Although the lever 70 is provided with the driving shafts 75, and the contact pressure applying member 20 is provided with the driving track 21 in the above-mentioned embodiments, a configuration may also be employed in which a lever is provided with driving tracks, and a contact pressure applying member is provided with a driving shaft.

(3) Although the contact pressure applying member 20 in which the driving portion 22 and the contact pressure applying portion 23 are provided at separate portions and coupled by the coupling portion 24 is shown as an example in the above-mentioned embodiments, a contact pressure applying member in which a driving portion and a contact pressure applying portion are continuously provided as a single body may also be used.

(4) Although the configuration in which the driving portion 22 is stored between the attachment target portion 68 and the lever 70 after the female housing 60 and the male housing 130 are completely fitted to each other is shown as an example in the above-mentioned embodiments, the driving portion may also be exposed to the outside at the attachment target portion.

(5) Although the rotary lever 70 is used in the above-mentioned embodiment, a slide lever may also be used.

(6) Although the box-shaped female terminals 110 including the polygonal tube portion 112 are used in the above-mentioned embodiments, cylindrical female terminals may also be used.

(7) Although the first seal 30 is attached to the flange 25 of the contact pressure applying member 20 in the above-mentioned embodiments, the first seal 30 may also be attached to the opening edge of the through hole 67 of the female housing 60.

(8) Although the fitting and removal of the male housing 130 and the driving of the contact pressure applying members are performed by rotating the lever 70 in Embodiments 1 to 3 above, a configuration may also be employed in which only the driving of the contact pressure applying members is performed by rotating the lever in the same manner as in Embodiment 4.

LIST OF REFERENCE NUMERALS

10, 200, 300, 400 . . . Lever-type connector
20, 410 . . . Contact pressure applying member
21 . . . Driving track
22, 412 . . . Driving portion
23, 230, 310 . . . Contact pressure applying portion
30 . . . First seal
50 . . . Second seal
60 . . . Female housing
67 . . . Through hole
68 . . . Attachment target portion
70, 420 . . . Lever
73 . . . Cam groove
73A . . . Fitting track
73B . . . Idling track
75 . . . Driving shaft
110, 210 . . . Female terminal
120, 220 . . . Male terminal
130 . . . Male housing
131 . . . Cam pin

The invention claimed is:

1. A lever-type connector comprising:

a female terminal configured to connect with a male terminal held in a male housing;

a female housing that internally accommodates the female terminal and configured to be fitted to the male housing;

a contact pressure applying member that is attached to the female housing from a front side in a fitting direction and can be moved between a low contact pressure position at which the female terminal is brought into contact with the male terminal with low contact pressure and a high contact pressure position that is located on a rear side in the fitting direction with respect to the low contact pressure position and at which the female terminal is brought into contact with the male terminal with high contact pressure due to application of contact pressure to the female terminal;

a lever that is movably attached to the female housing and moves the contact pressure applying member from the low contact pressure position to the high contact pressure position as a result of fitting the female terminal with the male terminal;

a first seal that provides a waterproof seal to a through hole in the female housing through which the contact pressure applying member passes; and a second seal that provides a waterproof seal to a fitting portion where the female housing and the male housing are fitted to each other, wherein the contact pressure applying member has an overall hook shape, the contact pressure applying member includes a driving portion, a contact pressure applying portion, and a coupling portion, the coupling portion couples the driving portion and the contact pressure applying portion, the driving portion protrudes rearward from one of two lateral edges of the coupling portion, the contact pressure applying portion protrudes rearward from the other of the two lateral edges of the coupling portion, and the driving portion and the contact pressure applying portions are arranged to face each other.

2. The lever-type connector according to claim 1, wherein the lever includes a cam groove, and the cam groove includes:

a fitting track configured to be engaged with a cam pin provided on the male housing and to thereby allow a fitting operation to be performed; and an idling track configured to allow the fitting operation to remain stopped when the lever is continuously moved after the completion of fitting.

3. The lever-type connector according to claim 1, wherein:

the lever includes a driving shaft, the contact pressure applying member includes:

a driving portion provided with a driving track configured to be engaged with the driving shaft and to thereby allow movement from the low contact pressure position to the high contact pressure position; and a contact pressure applying portion configured to press the female terminal and apply contact pressure, and the driving portion is provided passing through the through hole.

4. The lever-type connector according to claim 3, wherein:

the female housing includes an attachment target portion to which the driving portion is attached, and the driving portion is accommodated in a gap between the attachment target portion and the lever after the female housing and the male housing are completely fitted to each other.

* * * * *